US011202153B2

(12) United States Patent
Chen et al.

(10) Patent No.: US 11,202,153 B2
(45) Date of Patent: Dec. 14, 2021

(54) MEMS MICROPHONE

(71) Applicant: Fortemedia, Inc., Santa Clara, CA (US)

(72) Inventors: Jien-Ming Chen, Tainan (TW); Feng-Chia Hsu, Tainan (TW); Wen-Shan Lin, Tainan (TW); Hsin-Li Lee, Tainan (TW); Nai-Hao Kuo, Tainan (TW)

(73) Assignee: FORTEMEDIA, INC., Santa Clara, CA (US)

( * ) Notice: Subject to any disclaimer, the term of this patent is extended or adjusted under 35 U.S.C. 154(b) by 0 days.

(21) Appl. No.: 16/934,234

(22) Filed: Jul. 21, 2020

(65) Prior Publication Data

US 2021/0037320 A1 Feb. 4, 2021

Related U.S. Application Data

(60) Provisional application No. 62/879,569, filed on Jul. 29, 2019.

(51) Int. Cl.

| | |
|---|---|
| ***H04R 7/12*** | (2006.01) |
| ***H04R 7/16*** | (2006.01) |
| ***H04R 31/00*** | (2006.01) |
| ***H04R 19/04*** | (2006.01) |

(52) U.S. Cl.

CPC ..... *H04R 7/122* (2013.01); *H04R 7/16* (2013.01); *H04R 19/04* (2013.01); *H04R 31/003* (2013.01); *H04R 2201/003* (2013.01)

(58) Field of Classification Search

CPC .. H04R 2201/003; H04R 19/04; H04R 7/122; H04R 7/16; B81B 2201/0257

See application file for complete search history.

(56) References Cited

U.S. PATENT DOCUMENTS

2007/0058825 A1* 3/2007 Suzuki ..... H04R 19/04 381/174
2017/0359648 A1* 12/2017 Park ..... H04R 19/005
2018/0002167 A1* 1/2018 Frischmuth ..... G01L 1/005

FOREIGN PATENT DOCUMENTS

CN 110022519 A 7/2019

OTHER PUBLICATIONS

Chinese Language Office Action of its corresponding CN application No. 202010744147.7 dated Jul. 30, 2021.

* cited by examiner

*Primary Examiner* — Sunita Joshi
(74) *Attorney, Agent, or Firm* — McClure, Qualey & Rodack, LLP

(57) ABSTRACT

A micro-electro-mechanical system (MEMS) microphone is provided. The MEMS microphone includes a substrate, a backplate disposed on a side of the substrate, and a diaphragm movably disposed between the substrate and the backplate. The diaphragm includes a plurality of implantation portions, and the implantation portions have different concentration-depth profiles.

18 Claims, 25 Drawing Sheets

MEMS MICROPHONE

CROSS REFERENCE TO RELATED APPLICATIONS

The present application claims priority of U.S. Provisional Patent Application No. 62/879,569, filed on Jul. 29, 2019, the entirety of which is incorporated by reference herein.

BACKGROUND OF THE INVENTION

Field of the Invention

The invention relates to an acoustic transducer, and more particularly to a micro-electro-mechanical system (MEMS) microphone.

Description of the Related Art

The current tendency is toward fabricating slim, compact, lightweight and high-performance electronic devices, including microphones. A microphone is used to receive sound waves and convert acoustic signals into electric signals. Microphones are widely used in daily life and are installed in such electronic products as telephones, mobiles phones, and recording pens. In a capacitive microphone, variations in acoustic pressure (i.e. local pressure deviation from the ambient atmospheric pressure caused by sound waves) force the diaphragm to deform correspondingly, and the deformation of the diaphragm induces a capacitance variation. The variation of acoustic pressure of the sound waves can thus be obtained by detecting the voltage difference caused by the capacitance variation.

This is distinct from conventional electret condenser microphones (ECM), in which mechanical and electronic elements of micro-electro-mechanical system (MEMS) microphones can be integrated on a semiconductor material using integrated circuit (IC) technology to fabricate a miniature microphone. MEMS microphones have such advantages as a compact size, being lightweight, and having low power consumption, and they have therefore entered the mainstream of miniaturized microphones.

Although existing MEMS microphones have generally been adequate for their intended purposes, they have not been entirely satisfactory in all respects. For example, the compatible acoustic pressure range (i.e. dynamic range) of detectable sound waves in a MEMS microphone still needs improvement. The dynamic range is related to the highest compatible acoustic pressure (i.e. acoustic overload point, which is referred to hereinafter as the "AOP"), which is determined by the harmonic distortion rate (total harmonic distortion, which is referred to hereinafter as the "THD") of the MEMS microphone. On the other hand, if the diaphragm has a lower elastic modulus (i.e. lower stiffness), it can be used to sense a smaller acoustic pressure (i.e. have higher sensitivity), but the THD of the diaphragm will be sacrificed accordingly (i.e. the AOP will be reduced). Therefore, it cannot achieve high AOP and high sensitivity, simultaneously, of a MEMS microphone (i.e. unable to achieve a wider dynamic range).

BRIEF SUMMARY OF THE INVENTION

In view of the aforementioned problems, an object of the invention is to provide a MEMS microphone that can achieve high AOP and high sensitivity simultaneously.

An embodiment of the invention provides a MEMS microphone. The MEMS microphone micro-electro-mechanical system (MEMS) includes a substrate, a backplate disposed on a side of the substrate, and a diaphragm movably disposed between the substrate and the backplate. The diaphragm includes a plurality of implantation portions, and the implantation portions have different concentration-depth profiles.

In some embodiments, the diaphragm defines a coordinate system, and the implantation portions are arranged in a symmetrical manner with respect to an original point of the coordinate system.

In some embodiments, the coordinate system is a cylindrical coordinate system.

In some embodiments, the coordinate system is a Cartesian coordinate system.

In some embodiments, the concentrations in the implantation portions of the diaphragm are from 1E16 to 1E23 $cm^{-3}$.

In some embodiments, each of the implantation portions has a peak concentration, and the difference of the peak concentrations exceeds 0.1E16 cm−3.

In some embodiments, the implantation portions are implanted with p-type or n-type dopant.

In some embodiments, a plurality of slots are formed in an annular area of the diaphragm and separated from each other.

In some embodiments, a plurality of vent holes are formed on the diaphragm and separated from each other.

In some embodiments, the micro-electro-mechanical system (MEMS) microphone further includes an additional insulating layer connected between the backplate and the diaphragm.

In some embodiments, the implantation portions include a first implantation portion and a second implantation portion surrounding the first implantation portion, and the second implantation portion has a higher concentration than the first implantation portion.

In some embodiments, the implantation portions include two first implantation portions, and the second implantation portion is disposed between the first implantation portions, and the second implantation portion has a higher concentration than the first implantation portions.

In some embodiments, the implantation portions include a plurality of first implantation portions and a plurality of second implantation portions arranged in concentric circles, and each of the second implantation portions has a higher concentration than the first implantation portions.

In some embodiments, one of the first implantation portions is located at a center of the diaphragm.

In some embodiments, one of the second implantation portions is located at the center of the diaphragm.

In some embodiments, the concentrations of the second implantation portions are different from each other.

In some embodiments, the implantation portions include a first implantation portion and a plurality of second implantation portions radially arranged around the center of the diaphragm.

In some embodiments, the second implantation portions are encompassed by the first implantation portion.

In some embodiments, each of the second implantation portions has a fan-shaped structure.

In some embodiments, the second implantation portions extend to a perimeter of the diaphragm.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

Figure 1A:
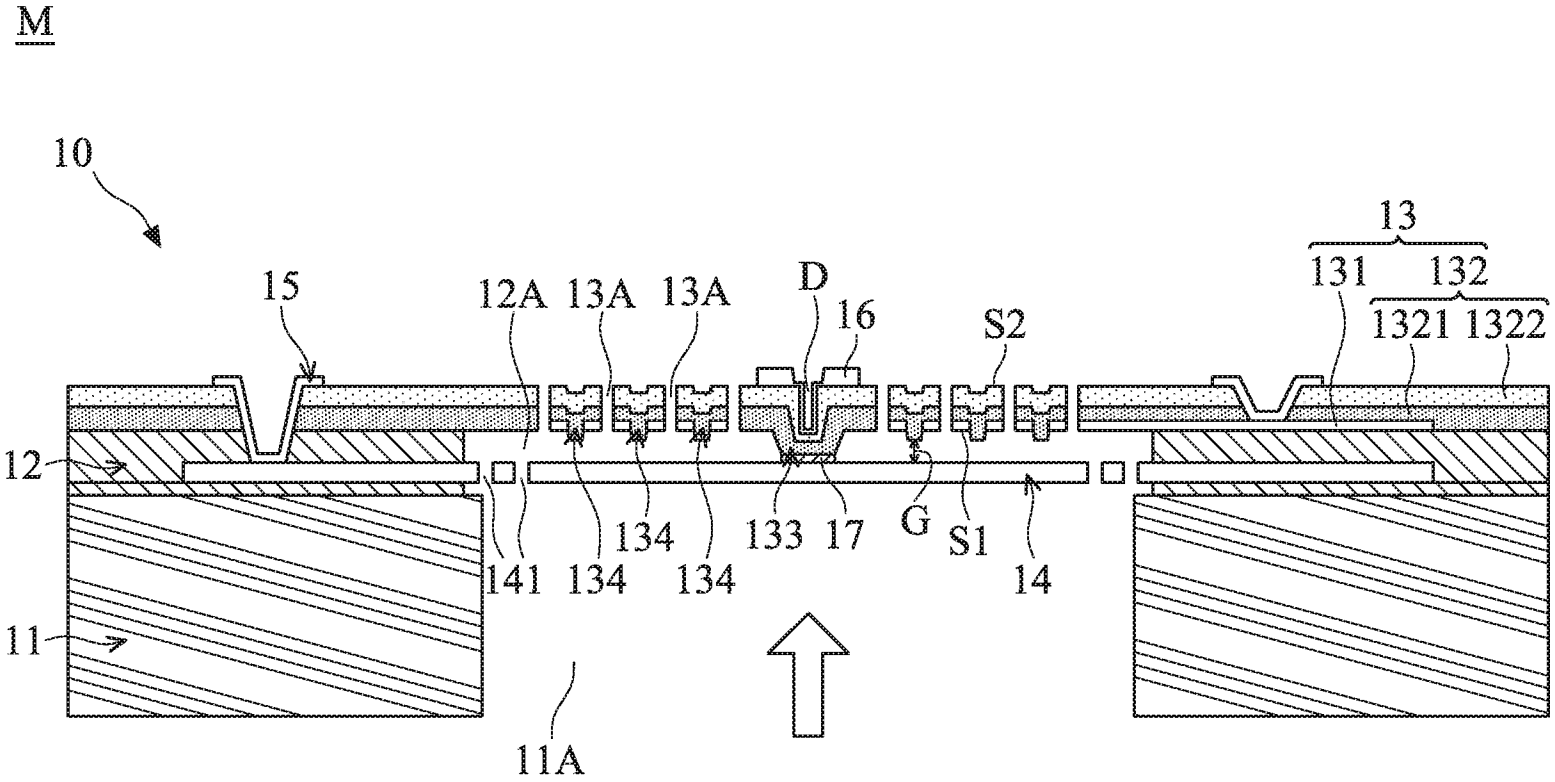
FIG. 1A schematically illustrates a cross-sectional view of a MEMS microphone, in accordance with some embodiments.

The following description is of the best-contemplated mode of carrying out the invention. This description is made for the purpose of illustrating the general principles of the invention and should not be taken in a limiting sense. The scope of the invention is best determined by reference to the appended claims.

In the following detailed description, the orientations of "on", "above", "under", and "below" are used for representing the relationship between the relative positions of each element as illustrated in the drawings, and are not meant to limit the invention. Moreover, the formation of a first element on or above a second element in the description that follows may include embodiments in which the first and second elements are formed in direct contact, or the first and second elements have one or more additional elements formed therebetween.

In addition, the present disclosure may repeat reference numerals and/or letters in the various examples. This repetition is for the purpose of simplicity and clarity and does not in itself dictate a relationship between the various embodiments and/or configurations discussed. Various features may be arbitrarily drawn in different scales for the sake of simplicity and clarity. Furthermore, some elements not shown or described in the embodiments have the forms known by persons skilled in the field of the invention.

In the present disclosure, a micro-electro-mechanical system (MEMS) microphone for detecting sound waves and converting the sound waves (acoustic signal) into electric signal is provided, in accordance with various exemplary embodiments. In particular, the MEMS microphones in the various embodiments can achieve high AOP (i.e. achieve a wider dynamic range) and high sensitivity simultaneously via the following described features. The variations of some embodiments are discussed. Throughout the various views and illustrative embodiments, like reference numbers are used to designate like elements.

FIG. 1A schematically illustrates a cross-sectional view of a MEMS microphone M, in accordance with some embodiments. It should be noted that the MEMS microphone M depicted in FIG. 1A has been simplified for the sake of clarity to better understand the inventive concepts of the present disclosure. Additional features can be added into the MEMS microphone M, and some of the features described below can be replaced or eliminated in other embodiments of the MEMS microphone M. As shown in FIG. 1A, the MEMS microphone M which is a capacitive microphone includes a MEMS structure 10 including a substrate 11, a dielectric layer 12, a backplate 13, a diaphragm 14, and an electrode layer 15.

The substrate 11 is configured to support the dielectric layer 12, the backplate 13, the diaphragm 14, and the electrode layer 15 on a side thereof. The substrate 11 may have an opening portion 11A which allows sound waves (e.g., as the arrow indicated in FIG. 1A) received by the MEMS microphone M to pass through and/or enter the MEMS structure 10. The substrate 11 may be made of silicon or the like.

The dielectric layer 12 is disposed between the substrate 11 and the diaphragm 14, and between the diaphragm 14 and the backplate 13, so as to provide partial isolation between the substrate 11, the diaphragm 14, and the backplate 13 from each other. Moreover, the dielectric layer 12 is disposed around the backplate 13 and the diaphragm 14, such that the backplate 13 and the diaphragm 14 are clamped at their edges by the dielectric layer 12. Furthermore, the dielectric layer 12 may have an opening portion 12A corresponding to the opening portion 11A of the substrate 11, so as to allow the sound waves to pass through the diaphragm 14 and the backplate 13 and then leave the MEMS structure 10. The dielectric layer 12 may be made of silicon oxide or the like.

The backplate 13 is a stationary element disposed on a side of the substrate 11. The backplate 13 may have sufficient stiffness such that it would not be bent or movable when the sound waves pass through the backplate 13. In some embodiments, the backplate 13 is a stiff perforated element including a number of acoustic holes 13A each passing through the backplate 13, as shown in FIG. 1A. The acoustic holes 13A are configured to allow the sound waves to pass through.

In some embodiments, the backplate 13 includes a conductive layer 131 and an insulating layer 132 covering the conductive layer 131 for protection, as shown in FIG. 1A. The conductive layer 131 and the insulating layer 132 are respectively located on a first side S1 of the backplate 13 facing the diaphragm 14 and a second side S2 of the backplate 13 opposite to the first side S1. The conductive layer 131 may be made of poly-silicon or the like, and the insulating layer 132 may be made of silicon nitride or the like.

In some embodiments, the MEMS structure 10 is electrically connected to a circuit (not shown) via several electrode pads of the electrode layer 15 that is disposed on the backplate 13 and electrically connected to the conductive layer 131 and the diaphragm 14. In some embodiments, the electrode layer 15 comprises copper, silver, gold, aluminum, or alloy thereof.

The diaphragm 14 is movable or displaceable relative to the backplate 13. The diaphragm 14 is configured to sense the sound waves received by the MEMS microphone M.

The displacement change of the diaphragm 14 relative to the backplate 13 causes a capacitance change between the diaphragm 14 and the backplate 13. The capacitance change is then converted into an electric signal by a circuitry connected with the diaphragm 14 and the backplate 13, and the electrical signal is sent out of the MEMS microphone M through the electrode layer 15.

In some embodiments, a first insulating protrusion 133 is provided or formed on the first side S1 of the backplate 13 facing the diaphragm 14, and the first insulating protrusion 133 is connected to and affixed to the diaphragm 14 permanently, as shown in FIG. 1A. In some embodiments, the first insulating protrusion 133 is integrally formed with the insulating layer 132 and protrudes toward the diaphragm 14. The first insulating protrusion 133 may be a solid column connecting the backplate 13 and (e.g. the center of) the diaphragm 14, so that the first insulating protrusion 133 supports the diaphragm 14 to increase stiffness of the diaphragm 14, thereby increasing the AOP of the MEMS microphone M.

In some embodiments, an additional insulating layer 17 is also provided and connected between the first insulating protrusion 133 and the diaphragm 14, as shown in FIG. 1A. The additional insulating layer 17 may include the same material as the dielectric layer 12 or another insulating material. However, the additional insulating layer 17 can be omitted in different embodiments.

On the other hand, in order to increase the sensitivity of the diaphragm 14, a number of long slots 141 may be provided in the diaphragm 14. In some embodiments, the long slots 141 in the diaphragm 14 are arranged in concentric circles close to the dielectric layer 12 (e.g., between the conductive layer 131 of the backplate 13 and the dielectric layer 12) and the long slots of adjacent circles are arranged alternately (see FIGS. 1 and 2A), so that the long slots 141 can serve as a spring in the diaphragm 14 to reduce the stiffness of the diaphragm 14. In some alternative embodiments, the number of concentric circles formed by the long slots 141 may be more than two. With this structural feature, high sensitivity of the MEMS microphone M can be achieved.

In addition, the long slots 141 in the diaphragm 14 are also configured to relieve the stress on the diaphragm 14.

In some embodiments, a number of second insulating protrusions 134 are also provided or formed on the first side S1 of the backplate 13, and an air gap G is formed between the diaphragm 14 and each of the second insulating protrusions 134, as shown in FIG. 1A. In addition, the air gap G between the diaphragm 14 and each of the second insulating protrusions 134 may be the same (but not limited thereto).

Still referring to FIG. 1A, to form the first insulating protrusion 133 and the second insulating protrusions 134, the insulating layer 132 of the backplate 13 may include a first insulating layer 1321 and a second insulating layer 1322 stacked on the first insulating layer 1321. In some embodiments, the first and second insulating layers 1321 and 1322 may comprise the same material or different material. In some embodiments, a protection layer 16 is provided to cover a recess D that is formed on the second side S2 and corresponding to the first insulating protrusion. The protection layer 16 may comprise conductive material (e.g., aluminum) or another material.

Figure 1B:
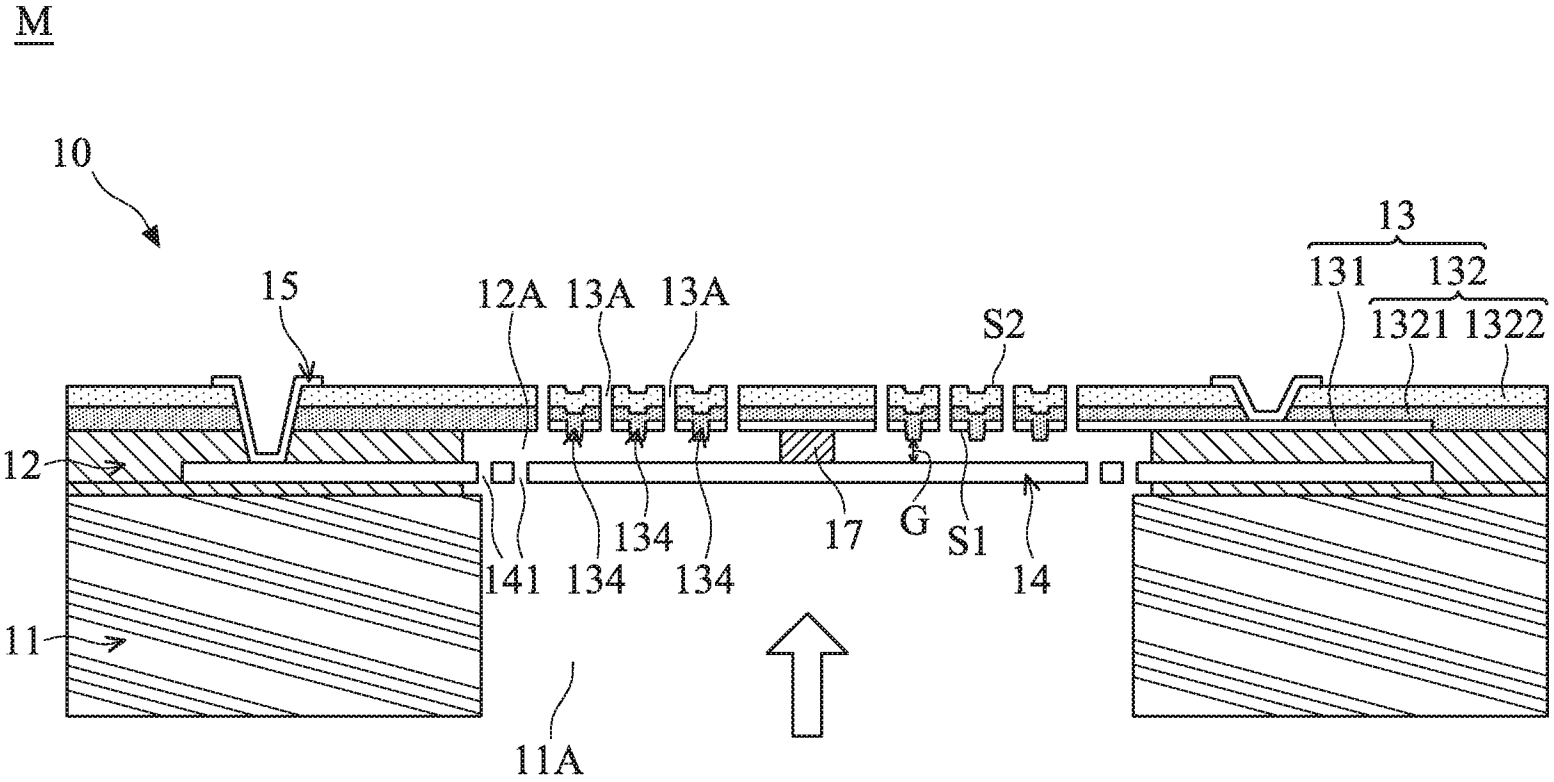
FIG. 1B schematically illustrates a cross-sectional view of a MEMS microphone, in accordance with another embodiment of the invention.

FIG. 1B schematically illustrates a cross-sectional view of a MEMS microphone M, in accordance with another embodiment of the invention. Referring to FIG. 1B, the first insulating protrusion 133 depicted in FIG. 1A can be omitted from the backplate 13, and the additional insulating layer 17 described above is provided and connected between the first side S1 of the backplate 13 and the diaphragm 14, so as to support the center portion of the diaphragm and increase the AOP of the diaphragm.

Figure 1C:
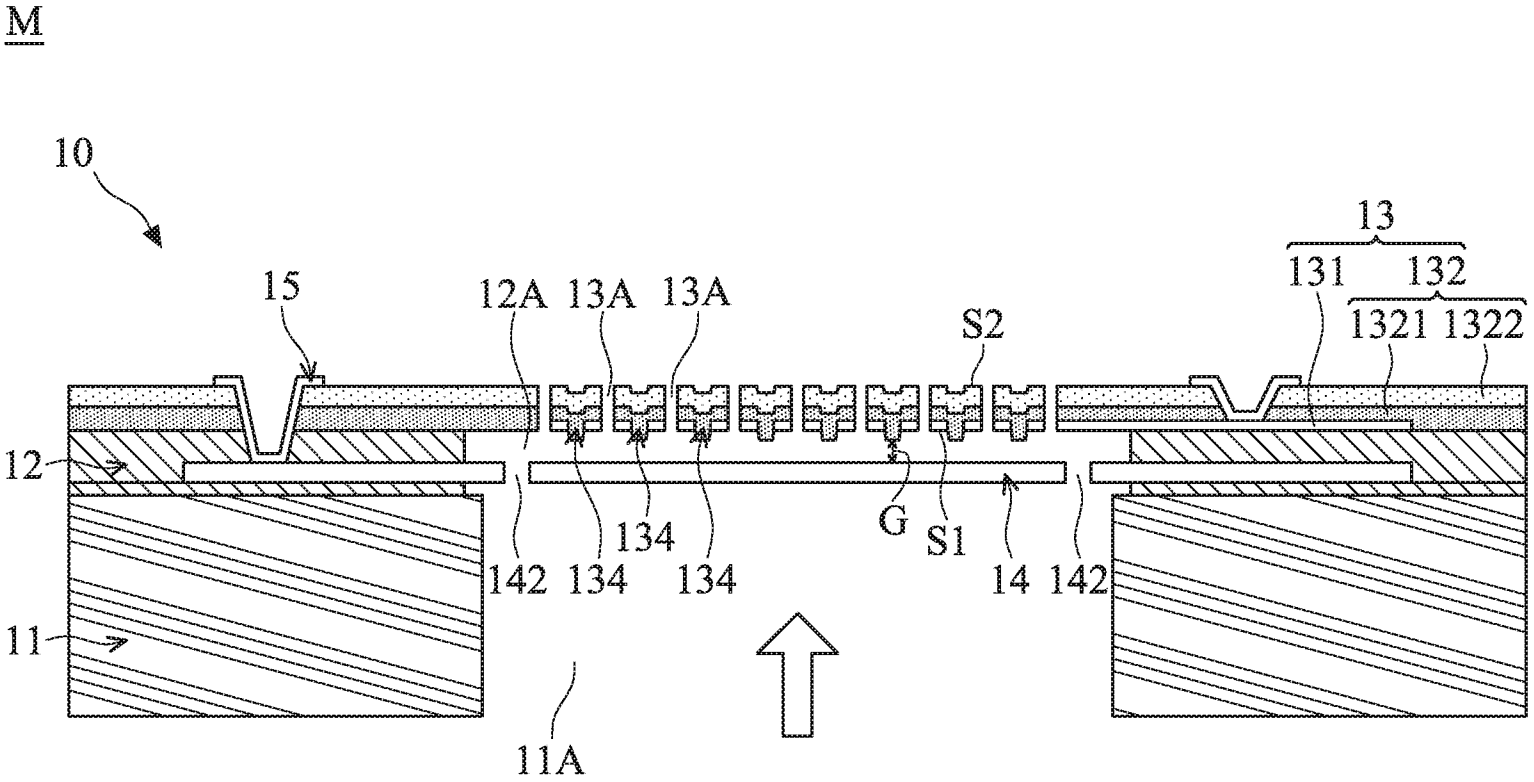
FIG. 1C schematically illustrates a cross-sectional view of a MEMS microphone, in accordance with another embodiment of the invention.

FIG. 1C schematically illustrates a cross-sectional view of a MEMS microphone M, in accordance with another embodiment of the invention. As shown in FIG. 1C, the additional insulating layer 17 depicted in FIGS. 1A and 1B can be omitted from the MEMS microphone M, and an air gap G is formed between the diaphragm 14 and each of the second insulating protrusions 134. Moreover, the long slots 141 depicted in FIGS. 1A and 1B can be replaced by a number of vent holes 142 formed on the diaphragm 14.

Figure 2A:
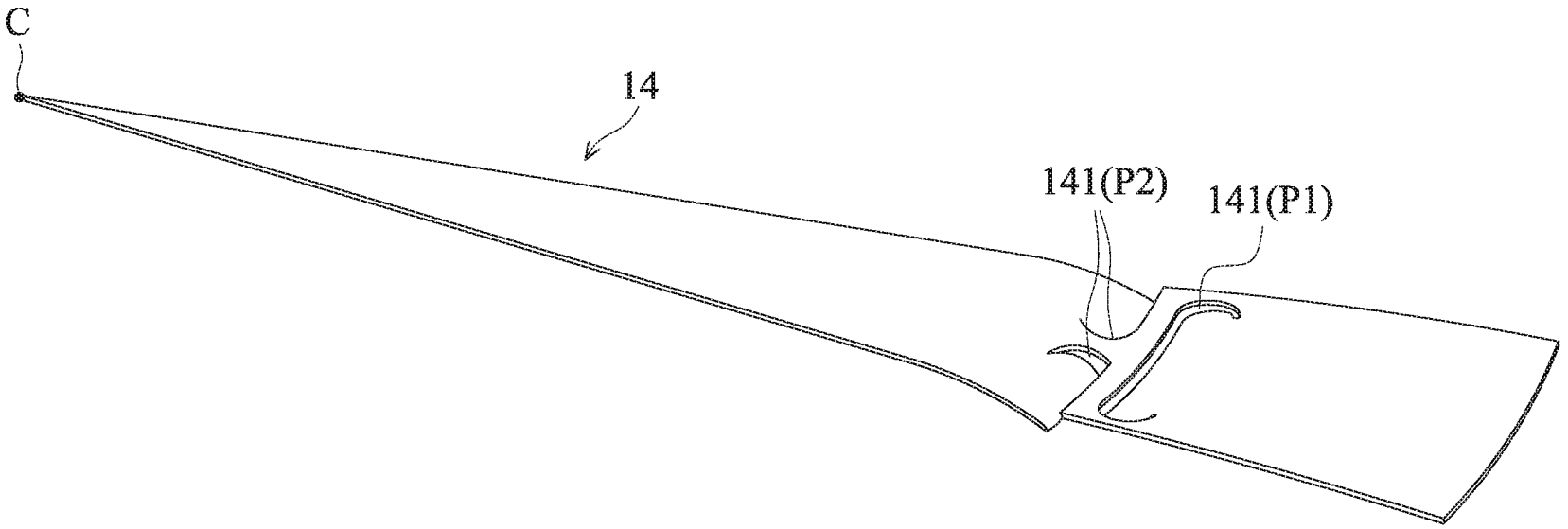
FIGS. 2A and 2B are perspective diagrams showing a fan-shaped part of the diaphragm 14 in FIG. 1A, 1B, or 1C.
Figure 2B:
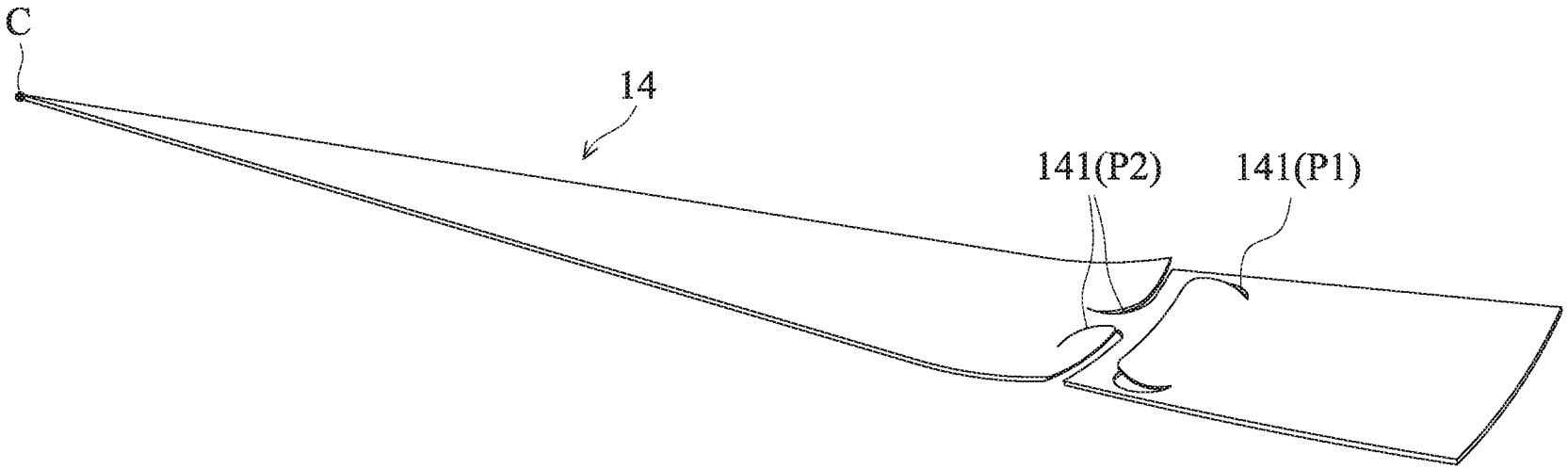

FIGS. 2A and 2B are perspective diagrams showing a fan-shaped part of the diaphragm 14 in FIG. 1A, 1B, or 1C. Referring to FIGS. 2A and 2B, the diaphragm 14 in this embodiment has a thin circular structure, wherein the long slots 141 includes a plurality of outer and inner slots P1 and P2 arranged around the center C of the diaphragm 14. When the diaphragm 14 is affected by acoustic pressure from ambient sound waves, air can flow downward (FIG. 2A) or upward (FIG. 2B) through the slots 141 to relieve the residual stress and endure the wind load on the diaphragm 14.

Figure 3:
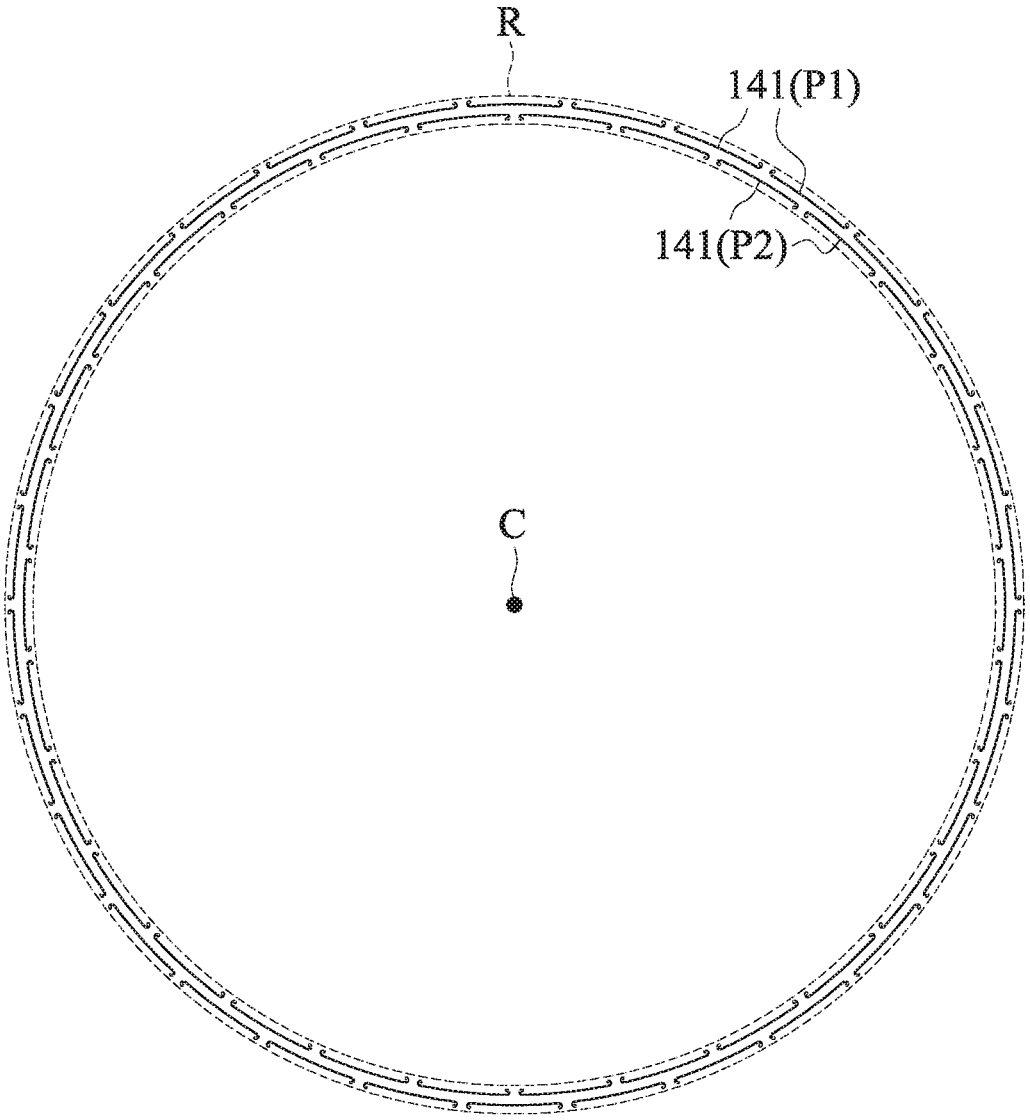
FIG. 3 is a schematic diagram showing the slots 141 arranged around the center C of the diaphragm 14, in accordance with an embodiment of the invention.

FIG. 3 is a schematic diagram showing the slots 141 arranged around the center C of the diaphragm 14, in accordance with an embodiment of the invention. Referring to FIG. 3, the outer and inner slots P1 and P2 are located within an annular area R of the diaphragm 14, and they are configured in concentric circles around the center C of the diaphragm 14. Moreover, the outer and inner slots P1 and P2 are arranged in a staggered manner with respect to the center C of the diaphragm 14.

Figure 4A:
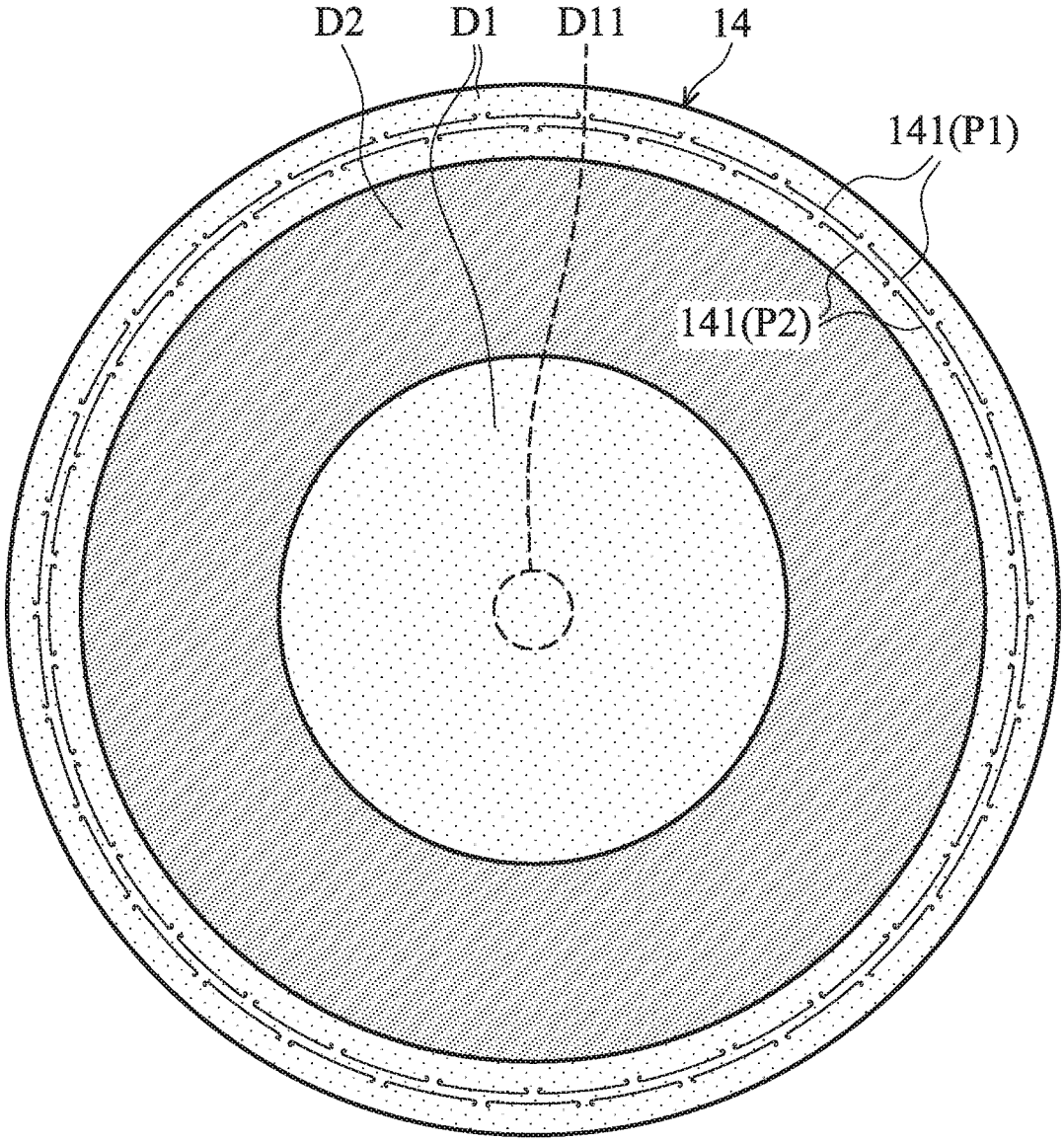
FIG. 4A is a schematic diagram showing a diaphragm 14 of the MEMS microphone M, in accordance with an embodiment of the invention.

FIG. 4A is a schematic diagram showing a diaphragm 14 of the MEMS microphone M, in accordance with an embodiment of the invention. Referring to FIG. 4A, the diaphragm 14 has a round shape, and it includes two implantation portions D1 and one implantation portion D2 located between the two the implantation portions D1. It should be noted that the diaphragm 14 may define a cylindrical coordinate system, and the implantation portions D1 and D2 are arranged in a symmetrical manner with respect to an original point of the cylindrical coordinate system (i.e. the center C of the diaphragm 14). In some embodiments, the diaphragm 14 may define a Cartesian coordinate system, and the implantation portions D1 and D2 are arranged in a symmetrical manner with respect to an original point of the Cartesian coordinate system (i.e. the center C of the diaphragm 14).

Here, the outer and inner slots P1 and P2 are formed on the outer implantation portion D1 that surrounds the implantation portion D2, and a small round area D11 is defined in the inner implantation portion D1 and connected to the additional insulating layer 17 (FIGS. 1A and 1B).

In this embodiment, the diaphragm 14 may be implanted with a p-type or n-type dopant (e.g. phosphorus or boron), and the concentrations in the implantation portions D1 and D2 of the diaphragm 14 are from 1E16 to 1E23 $cm^{-3}$. Specifically, the implantation portion D2 has a concentration-depth profile different from the two implantation portions D1, wherein the average concentration in the implantation portion D2 is higher than that in the two implantation portions D1. As a result, the implantation portion D2 can have a more flexible structure than the implantation portions D1, thereby increasing the AOP and SNR (Signal-to-Noise Ratio) of the MEMS microphone M. In some embodiments, the difference of peak concentrations between implantation portion D1 and the implantation portion D2 exceeds 0.1E16 $cm^{-3}$.

Figure 4B:
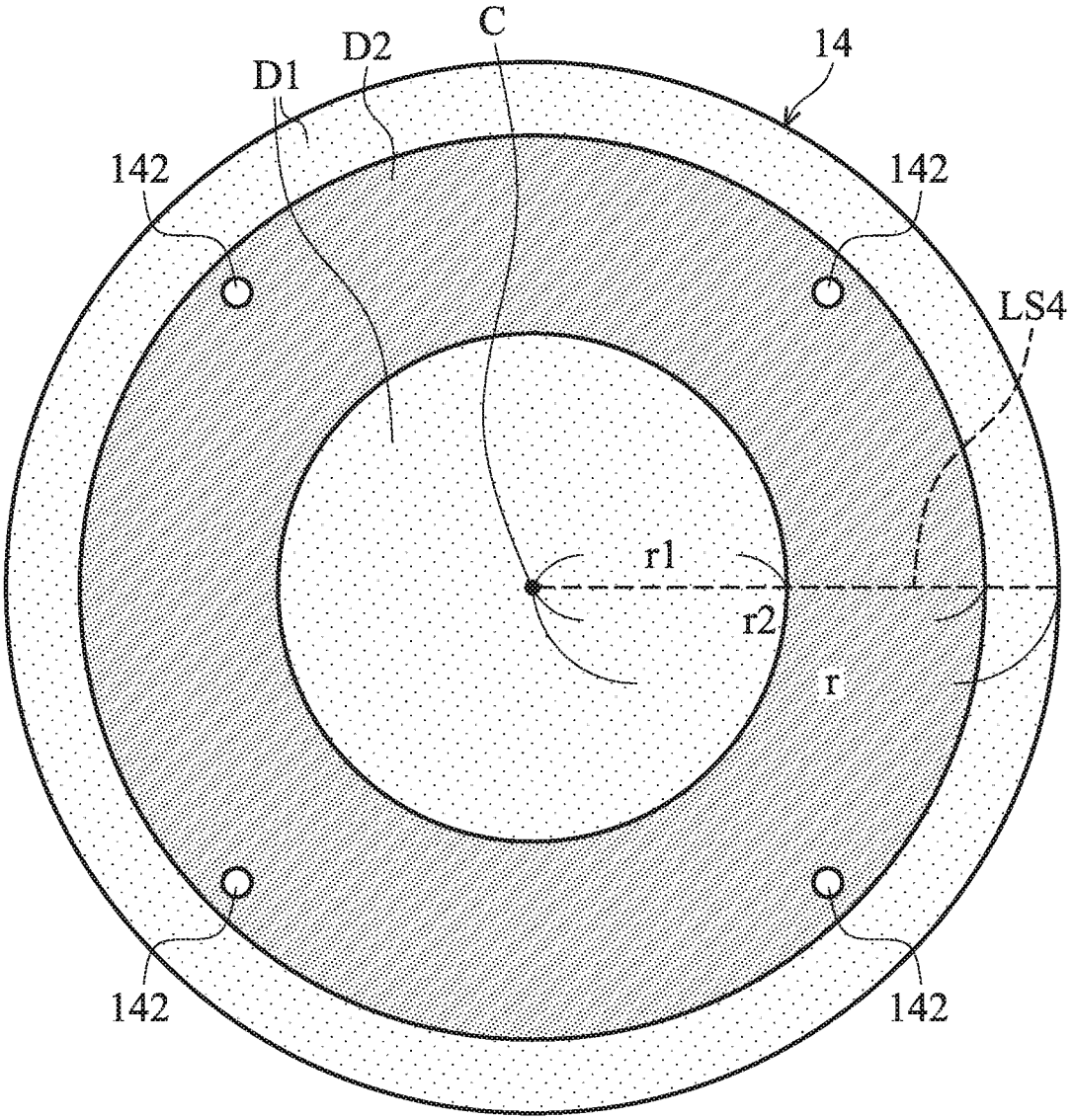
FIG. 4B is a schematic diagram showing a diaphragm 14 of the MEMS microphone M, in accordance with another embodiment of the invention.

FIG. 4B is a schematic diagram showing a diaphragm 14 of the MEMS microphone M, in accordance with another embodiment of the invention. Referring to FIG. 4B, the diaphragm 14 in this embodiment is different from FIG. 4A in that the long slots 141 are replaced by a number of vent holes 142 formed on the implantation portion D2, and the center C of the diaphragm 14 is spaced apart from the second insulating protrusions 134, as the air gap G shown in FIG. 1C.

Figure 4C:
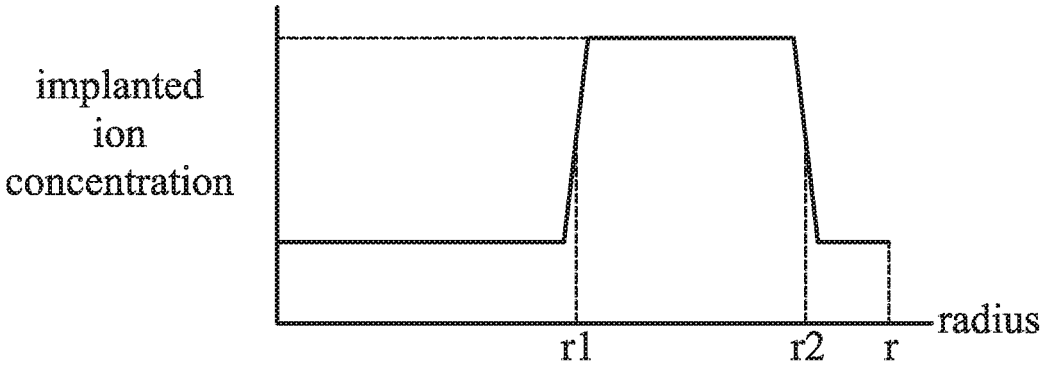
FIG. 4C shows the relationship between the implanted ion concentration and the radius of the diaphragm 14 in FIG. 4B.

FIG. 4C shows the relationship between the implanted ion concentration and the radius of the diaphragm 14 along line LS4 in FIG. 4B. Referring to FIGS. 4B and 4C, the inner implantation portion D1 of the diaphragm 14 has a maximum radius r1, the implantation portion D2 of the diaphragm 14 has a maximum radius r2, and the outer implantation portion D1 of the diaphragm 14 has a maximum radius r, wherein r>r2>r1. Since the implanted ion concentration in the implantation portion D2 is higher than that in the two implantation portions D1, the implantation portion D2 can be more flexible than the two implantation portions D1, thereby increasing the AOP and SNR of the MEMS microphone M.

Figure 4D:
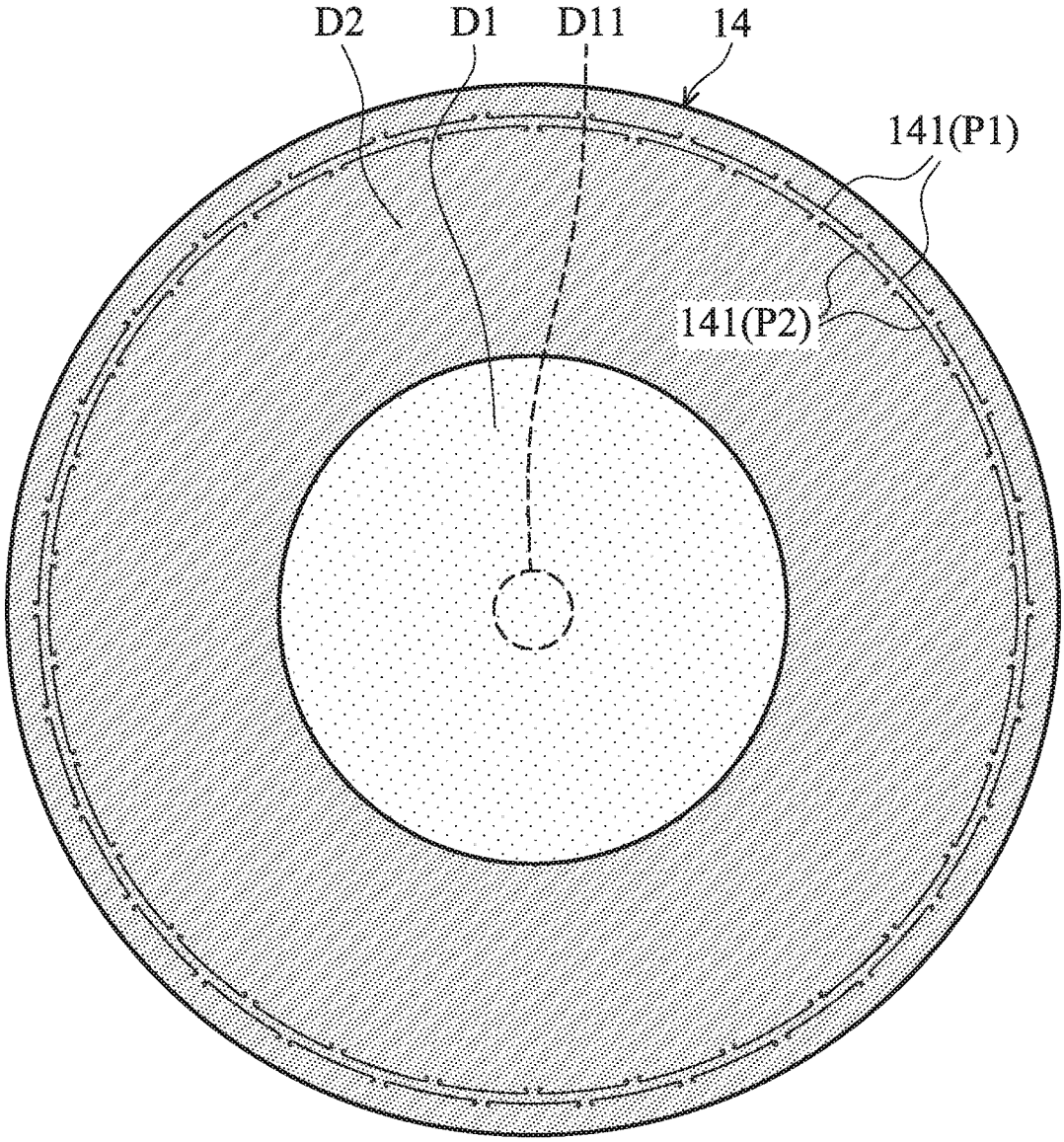
FIG. 4D is a schematic diagram showing a diaphragm 14 of the MEMS microphone M, in accordance with another embodiment of the invention.

FIG. 4D is a schematic diagram showing a diaphragm 14 of the MEMS microphone M, in accordance with another embodiment of the invention. Referring to FIG. 4D, the diaphragm 14 in this embodiment is different from FIG. 4A in that the diaphragm 14 only includes one implantation portion D1 and one implantation portion D2 that surrounds the implantation portion D1.

Here, the outer and inner slots P1 and P2 are formed on the implantation portion D2, and a small round area D11 is defined in the implantation portion D1 and connected to the additional insulating layer 17 (FIGS. 1A and 1B).

Figure 4E:
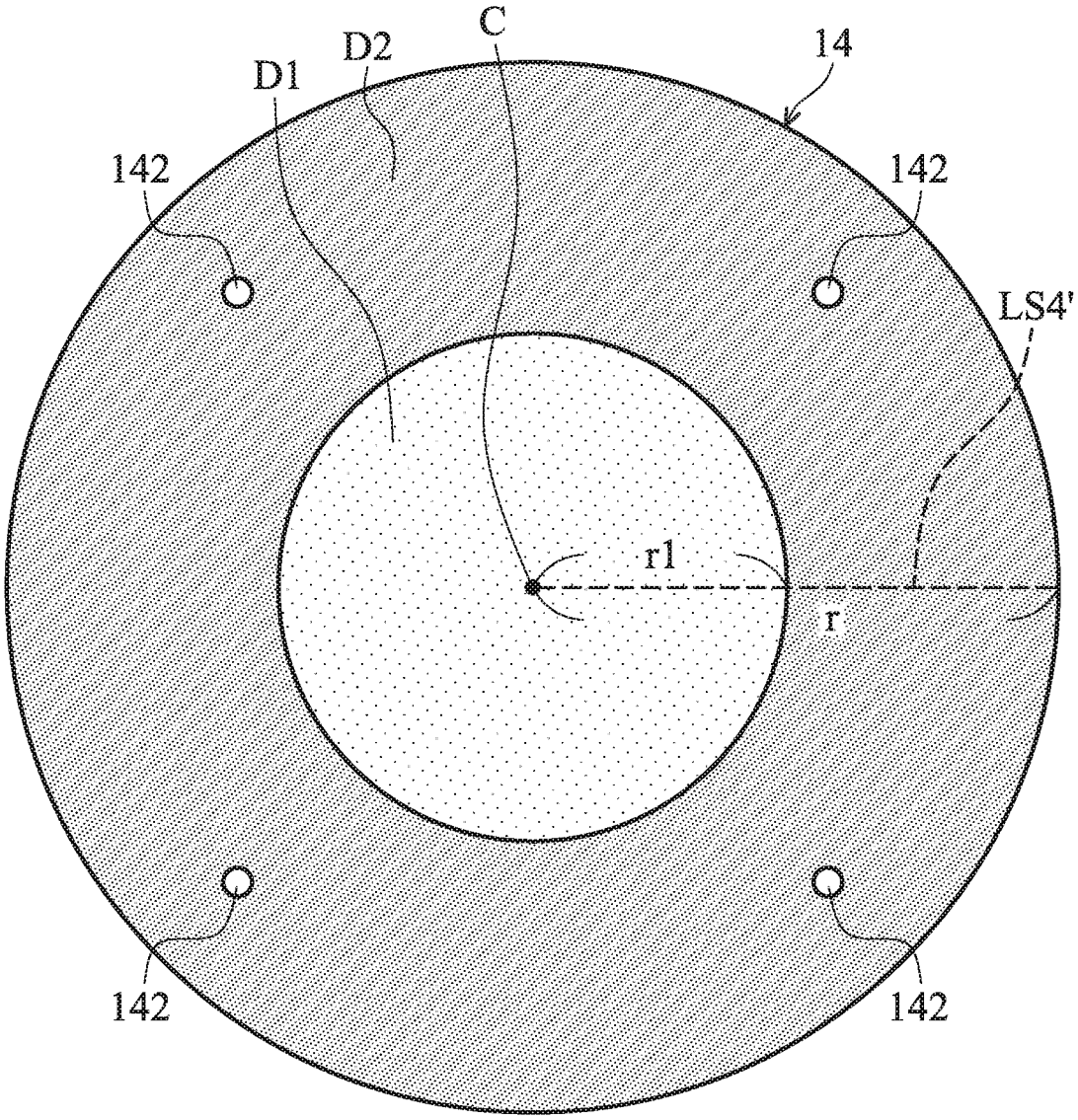
FIG. 4E is a schematic diagram showing a diaphragm 14 of the MEMS microphone M, in accordance with another embodiment of the invention.

FIG. 4E is a schematic diagram showing a diaphragm 14 of the MEMS microphone M, in accordance with another embodiment of the invention. Referring to FIG. 4E, the diaphragm 14 in this embodiment is different from FIG. 4D in that the long slots 141 are replaced by a number of vent holes 142 formed on the implantation portion D2, and the center C of the diaphragm 14 is spaced apart from the second insulating protrusions 134, as the air gap G shown in FIG. 1C.

Figure 4F:
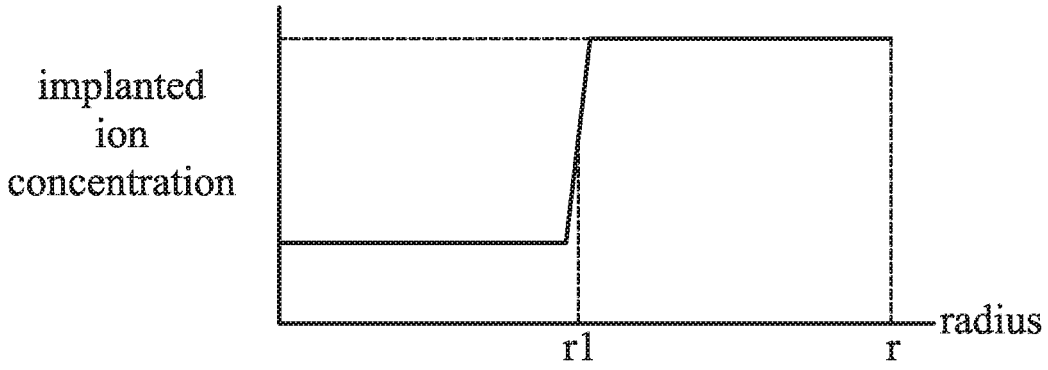
FIG. 4F shows the relationship between the implanted ion concentration and the radius of the diaphragm 14 along line LS4 in FIG. 4E.

FIG. 4F shows the relationship between the implanted ion concentration and the radius of the diaphragm 14 along line LS4' in FIG. 4E. Referring to FIGS. 4E and 4F, the implantation portion D1 of the diaphragm 14 has a maximum radius r1, and the implantation portion D2 of the diaphragm 14 has a maximum radius r, wherein r>r1. Since the implanted ion concentration in the implantation portion D2 is higher than that in the implantation portion D1, the implantation portion D2 is more flexible than the implantation portion D1, thereby increasing the AOP and SNR of the MEMS microphone M.

Figure 4G:
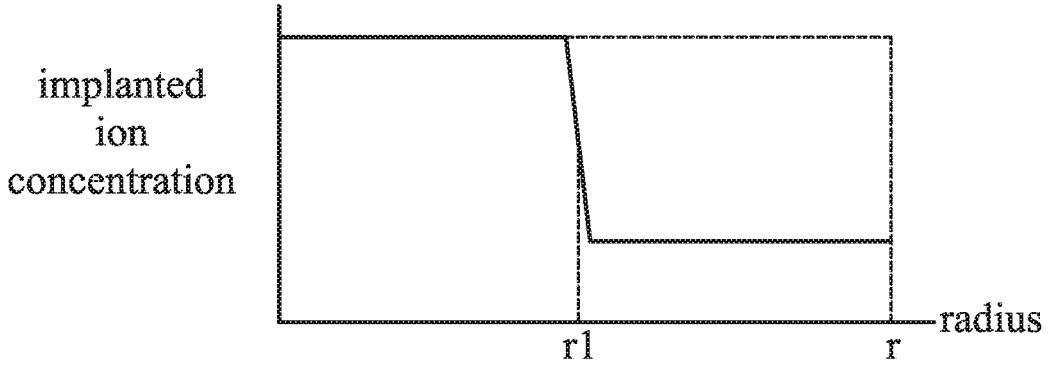
FIG. 4G shows the relationship between the implanted ion concentration and the radius of the diaphragm 14 along line LS4' in FIG. 4E, in accordance with another embodiment of the invention.

FIG. 4G shows the relationship between the implanted ion concentration and the radius of the diaphragm 14 along line LS4' in FIG. 4E, in accordance with another embodiment of the invention. Referring to FIG. 4G, in another embodiment of the diaphragm 14, the implanted ion concentration in the implantation portion D1 may be higher than that in the implantation portion D2, so that the implantation portion D1 is more flexible than the implantation portion D2 to increase the AOP and SNR of the MEMS microphone M. It should noted that the relationships between the implanted ion concentration and the radius of the diaphragm 14 as shown in FIGS. 4F and 4G can be applied to the diaphragm 14 of FIG. 4D that has long slots 141 or the diaphragm 14 of FIG. 4E that has vent holes 142.

Figure 5A:
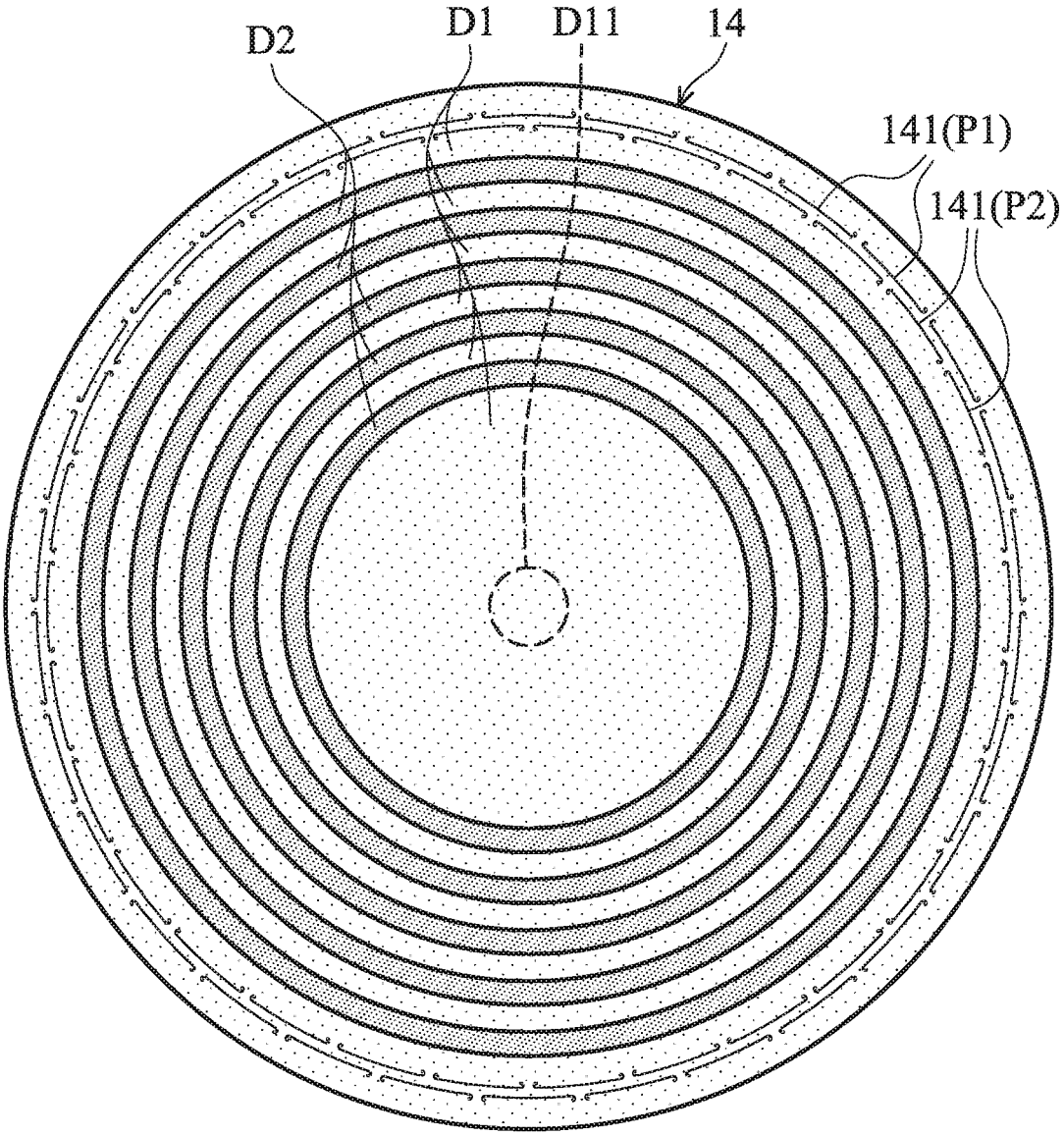
FIG. 5A is a schematic diagram showing a diaphragm 14 of the MEMS microphone M, in accordance with another embodiment of the invention.

FIG. 5A is a schematic diagram showing a diaphragm 14 of the MEMS microphone M, in accordance with another embodiment of the invention. Referring to FIG. 5A, the diaphragm 14 in this embodiment is different from FIG. 4A in that the diaphragm 14 includes several ring-shaped implantation portions D1 and implantation portions D2 arranged in concentric circles, and the outer and inner slots P1 and P2 are formed on the outermost implantation portion D1 that surrounds all of the implantation portions D2. Here, a small round area D11 is defined in the inner implantation portion D1 and connected to the additional insulating layer 17 (FIGS. 1A and 1B).

It should be noted that each of the implantation portions D2 has an average concentration higher than the implantation portions D1. In some embodiments, the difference of peak concentrations between any one of the implantation portions D1 and any one of the implantation portions D2 exceeds 0.1E16 $cm^{-3}$.

Figure 5B:
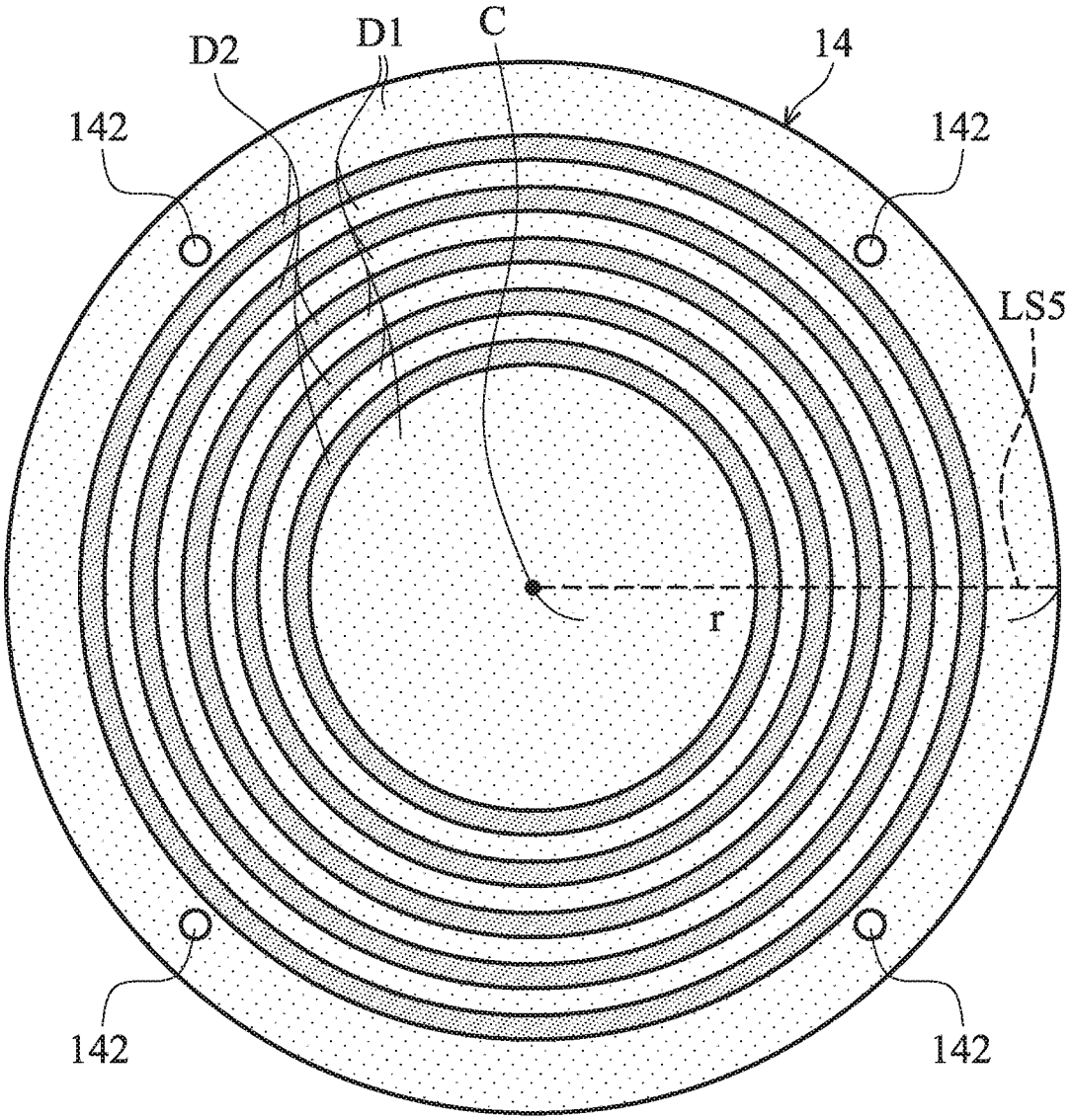
FIG. 5B is a schematic diagram showing a diaphragm 14 of the MEMS microphone M, in accordance with another embodiment of the invention.

FIG. 5B is a schematic diagram showing a diaphragm 14 of the MEMS microphone M, in accordance with another embodiment of the invention. Referring to FIG. 5B, the diaphragm 14 in this embodiment is different from FIG. 5A in that the long slots 141 are replaced by a number of vent holes 142 formed on the outermost implantation portion D1, and the center C of the diaphragm 14 is spaced apart from the second insulating protrusions 134, as the air gap G shown in FIG. 1C.

Figure 5C:
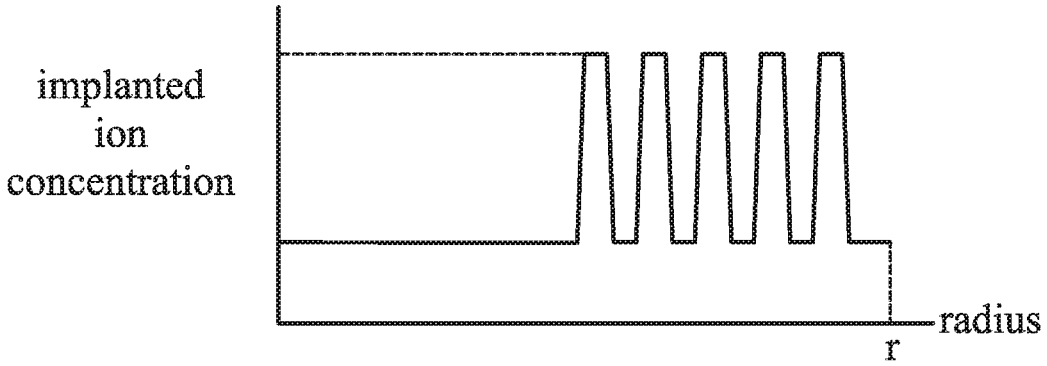
FIG. 5C shows the relationship between the implanted ion concentration and the radius of the diaphragm 14 along line LS5 in FIG. 5B.

FIG. 5C shows the relationship between the implanted ion concentration and the radius of the diaphragm 14 along line LS5 in FIG. 5B. Referring to FIGS. 5B and 5C, the outermost implantation portion D1 of the diaphragm 14 has a maximum radius r, and a regular sawtooth-like curve is presented in FIG. 5C. Here, since the implanted ion concentrations in the implantation portions D2 are higher than the implantation portions D1, the implantation portions D2 can be more flexible than the implantation portions D1, thereby increasing the AOP and SNR of the MEMS microphone M.

Figure 5D:
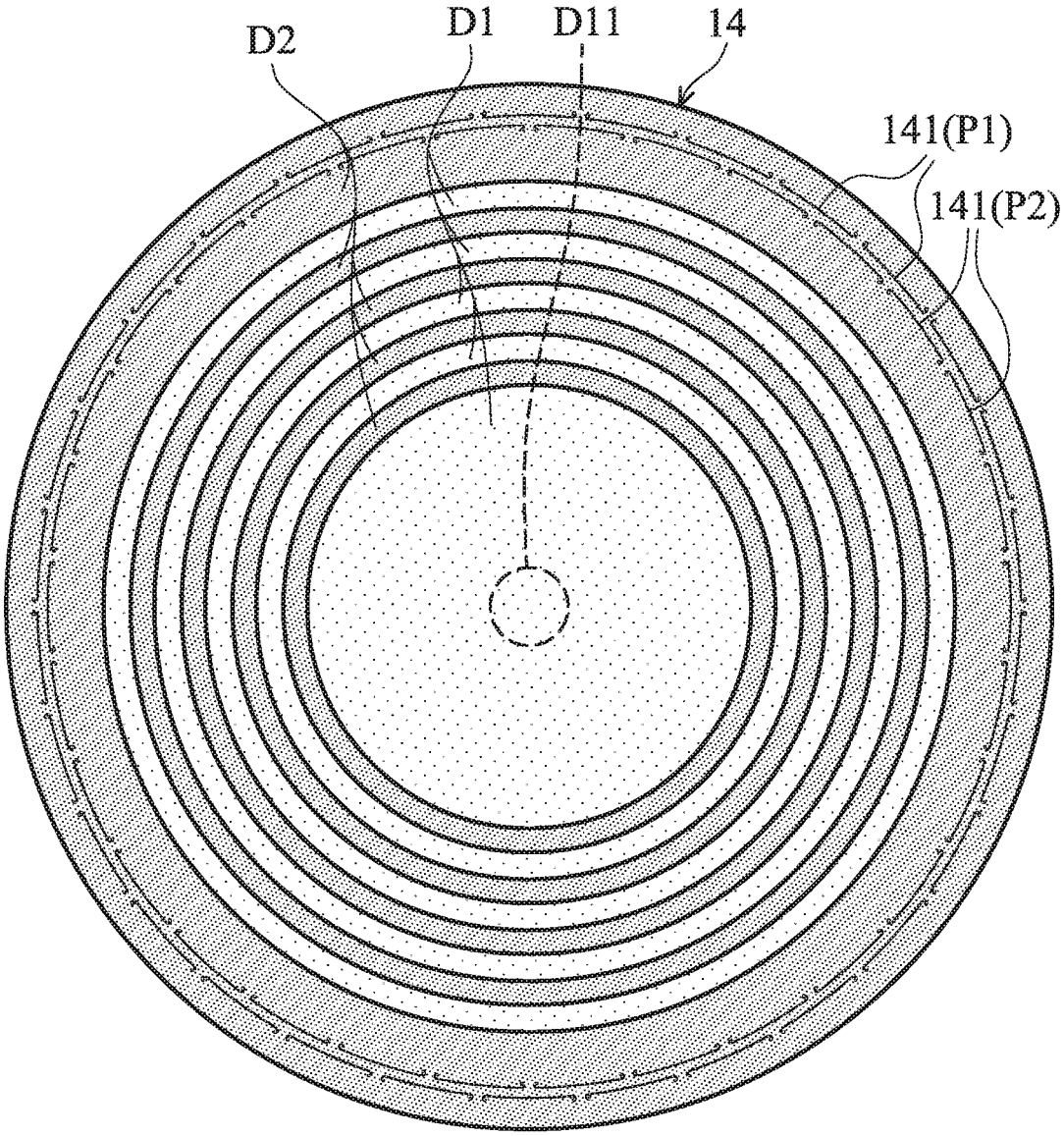
FIG. 5D is a schematic diagram showing a diaphragm 14 of the MEMS microphone M, in accordance with another embodiment of the invention.

FIG. 5D is a schematic diagram showing a diaphragm 14 of the MEMS microphone M, in accordance with another embodiment of the invention. Referring to FIG. 5D, the diaphragm 14 in this embodiment is different from FIG. 5A in that the outer and inner slots P1 and P2 are formed on the outermost implantation portion D2 that surrounds all of the implantation portions D1.

Figure 5E:
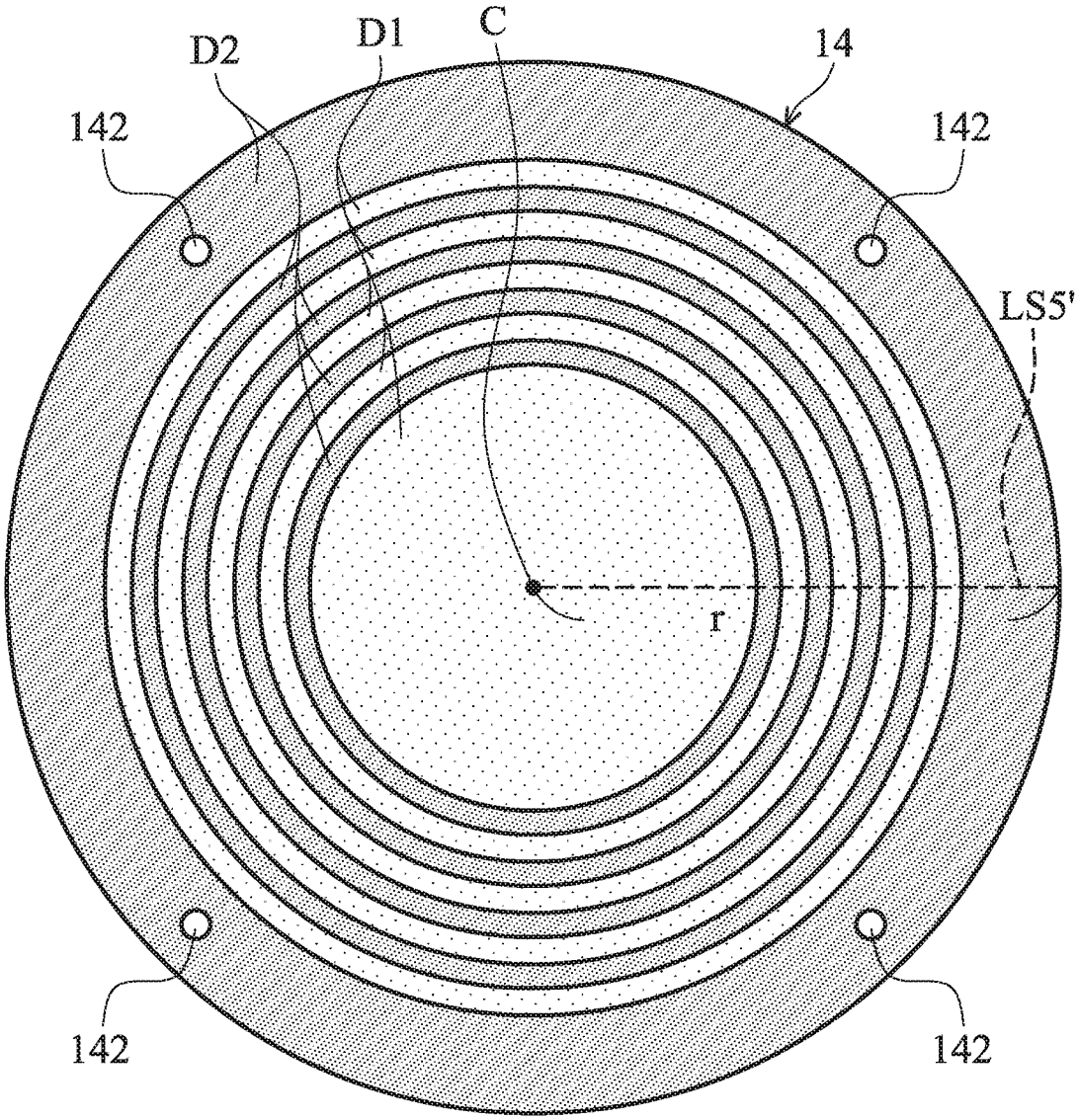
FIG. 5E is a schematic diagram showing a diaphragm 14 of the MEMS microphone M, in accordance with another embodiment of the invention.

FIG. 5E is a schematic diagram showing a diaphragm 14 of the MEMS microphone M, in accordance with another embodiment of the invention. Referring to FIG. 5E, the diaphragm 14 in this embodiment is different from FIG. 5D in that the long slots 141 are replaced by a number of vent holes 142 formed on the outermost implantation portion D2, and the center C of the diaphragm 14 is spaced apart from the second insulating protrusions 134, as the air gap G shown in FIG. 1C.

Figure 5F:
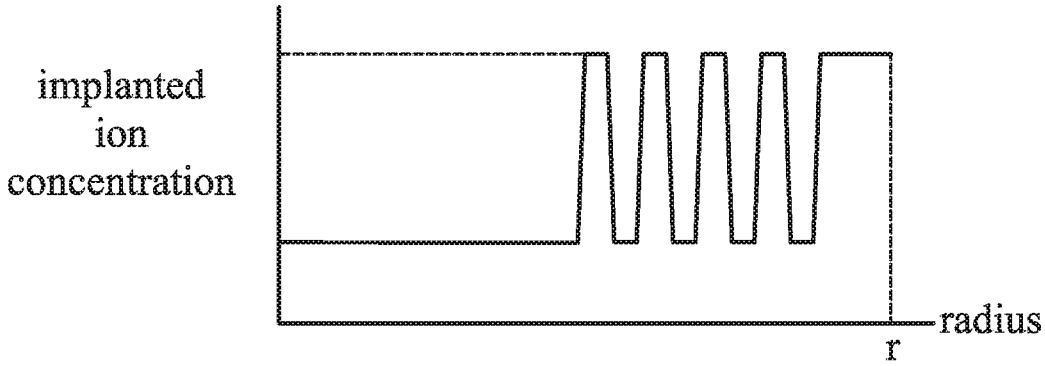
FIG. 5F shows the relationship between the implanted ion concentration and the radius of the diaphragm 14 along line LS5' in FIG. 5E.

FIG. 5F shows the relationship between the implanted ion concentration and the radius of the diaphragm 14 along line LS5' in FIG. 5E. Referring to FIGS. 5E and 5F, the outermost implantation portion D2 of the diaphragm 14 has a maximum radius r, and a regular sawtooth-like curve is presented in FIG. 5F. Since the implanted ion concentrations in the implantation portions D2 are higher than the implantation portions D1, the implantation portions D2 can be more flexible than the implantation portions D1, thereby increasing the AOP and SNR of the MEMS microphone M.

Figure 5G:
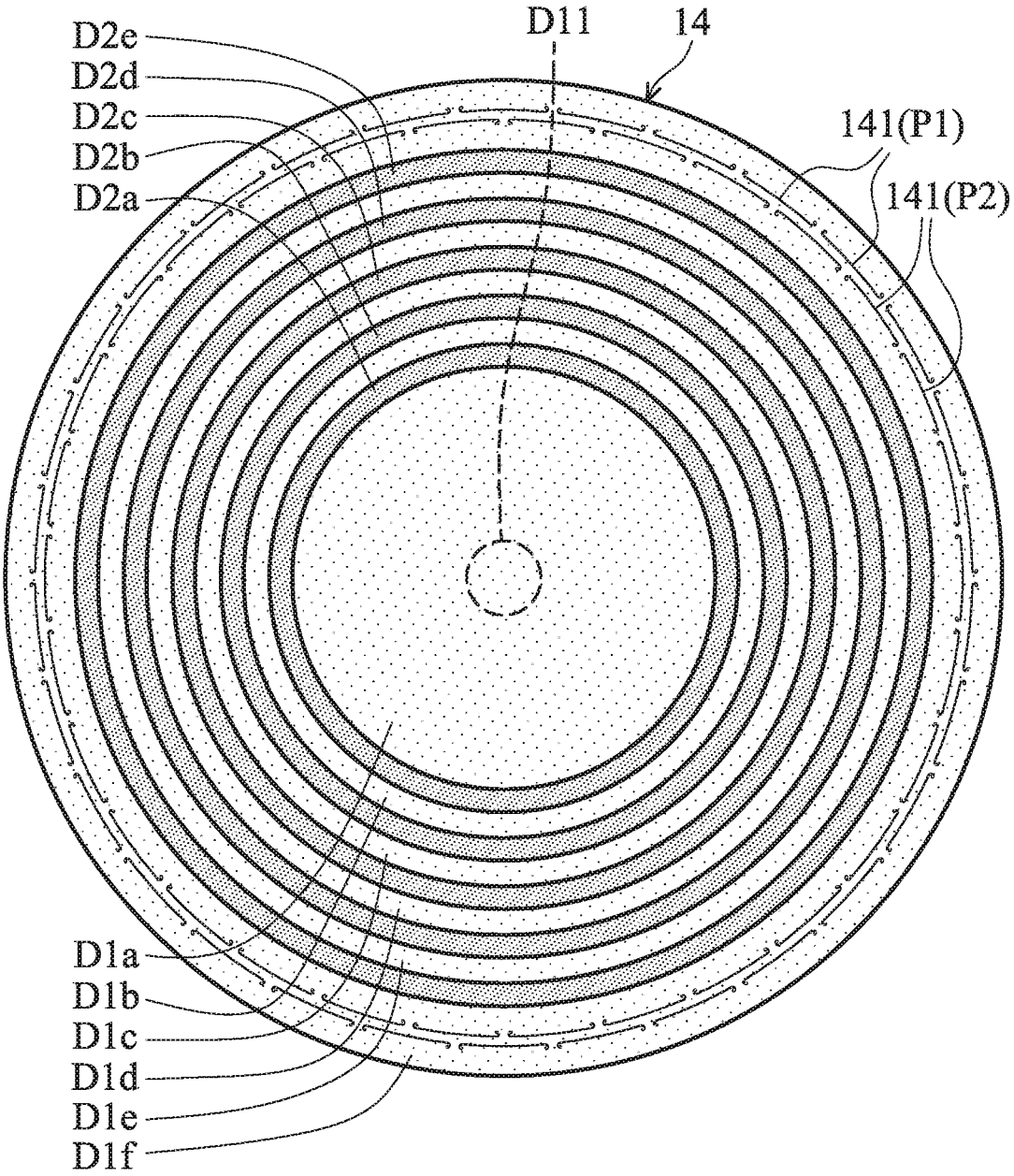
FIG. 5G is a schematic diagram showing a diaphragm 14 of the MEMS microphone M, in accordance with another embodiment of the invention.

FIG. 5G is a schematic diagram showing a diaphragm 14 of the MEMS microphone M, in accordance with another embodiment of the invention. Referring to FIG. 5G, the diaphragm 14 in this embodiment is different from FIG. 5A in that the diaphragm 14 includes several implantation portions D1*a*-D1*f* and D2*a*-D2*e* arranged in concentric circles, wherein the implantation portions D1*a*-D1*f* and D2*a*-D2*e* have different implanted ion concentrations. Here, the concentrations in the implantation portions D2*a*-D2*f* are higher than the implantation portions D1*a*-D1*f*.

Figure 5H:
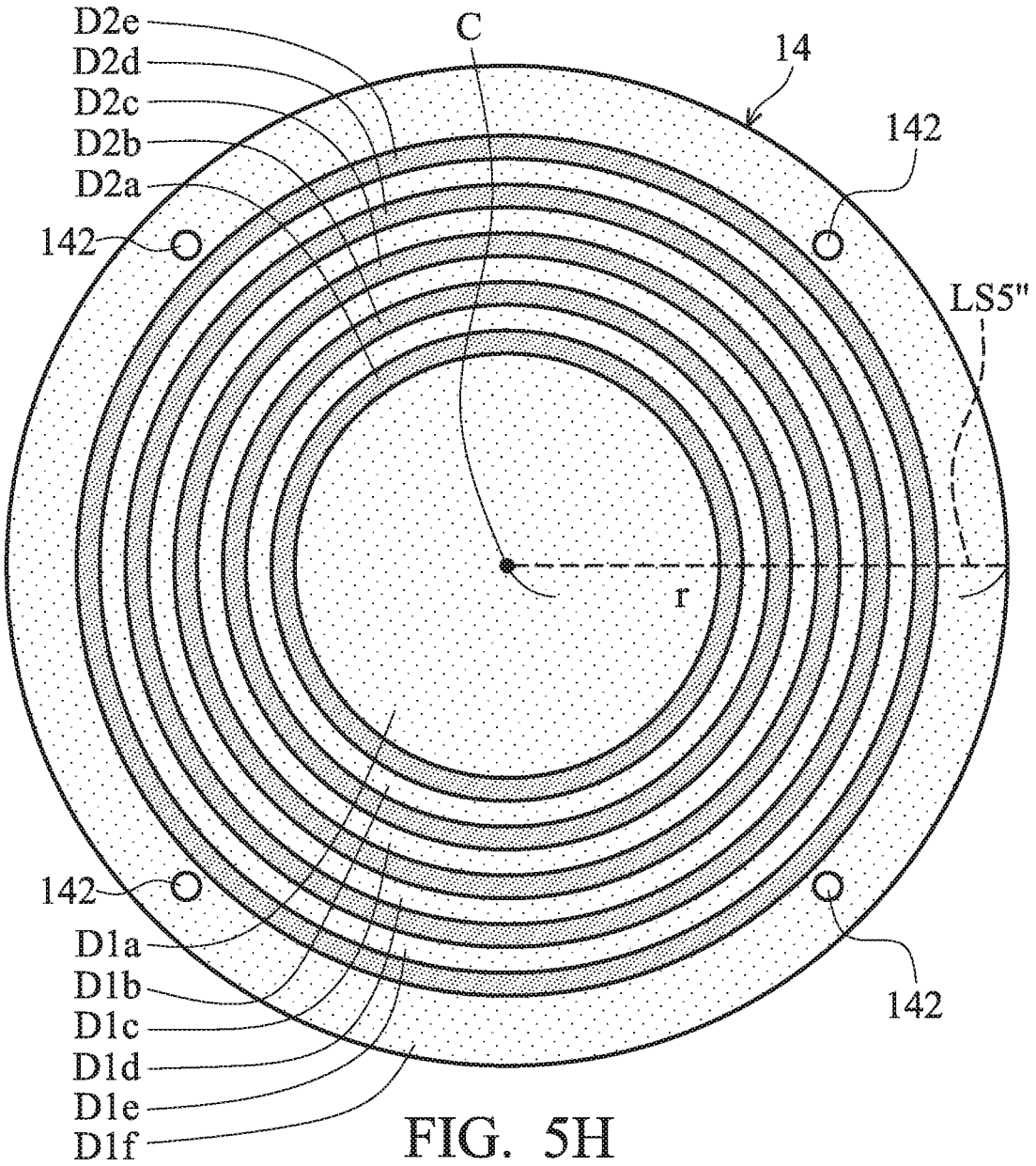
FIG. 5H is a schematic diagram showing a diaphragm 14 of the MEMS microphone M, in accordance with another embodiment of the invention.

FIG. 5H is a schematic diagram showing a diaphragm 14 of the MEMS microphone M, in accordance with another embodiment of the invention. Referring to FIG. 5H, the diaphragm 14 in this embodiment is different from FIG. 5G in that the long slots 141 are replaced by a number of vent holes 142 formed on the outermost implantation portion D1*f*, and the center C of the diaphragm 14 is spaced apart from the second insulating protrusions 134, as the air gap G shown in FIG. 1C.

Figure 5I:
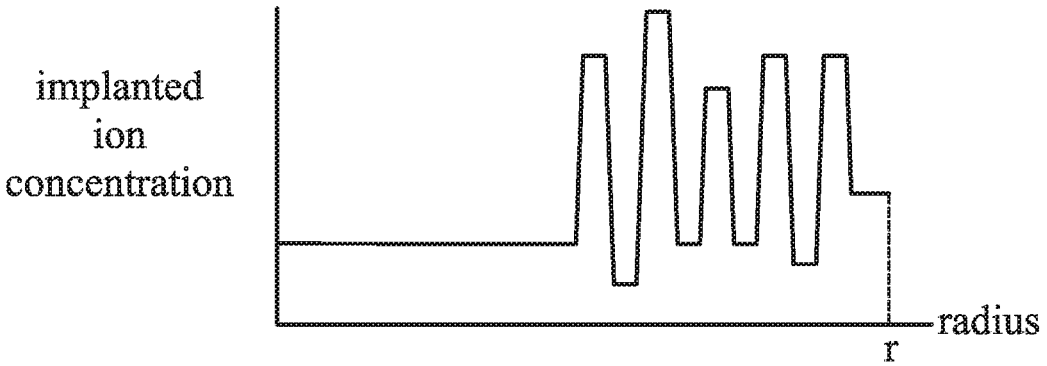
FIG. 5I shows the relationship between the implanted ion concentration and the radius of the diaphragm 14 along line LS5" in FIG. 5H.

FIG. 5I shows the relationship between the implanted ion concentration and the radius of the diaphragm 14 along line LS5" in FIG. 5H. Referring to FIGS. 5H and 5I, the outermost implantation portion D1*f* of the diaphragm 14 has a maximum radius r, and an irregular sawtooth-like curve is presented in FIG. 5I. Since the implanted ion concentrations in the implantation portions D2*a*-D2*e* are higher than the implantation portions D1*a*-D1*f*, the implantation portions D2*a*-D2*e* can be more flexible than the implantation portions D1*a*-D1*f*, thereby increasing the AOP and SNR of the MEMS microphone M.

Figure 6A:
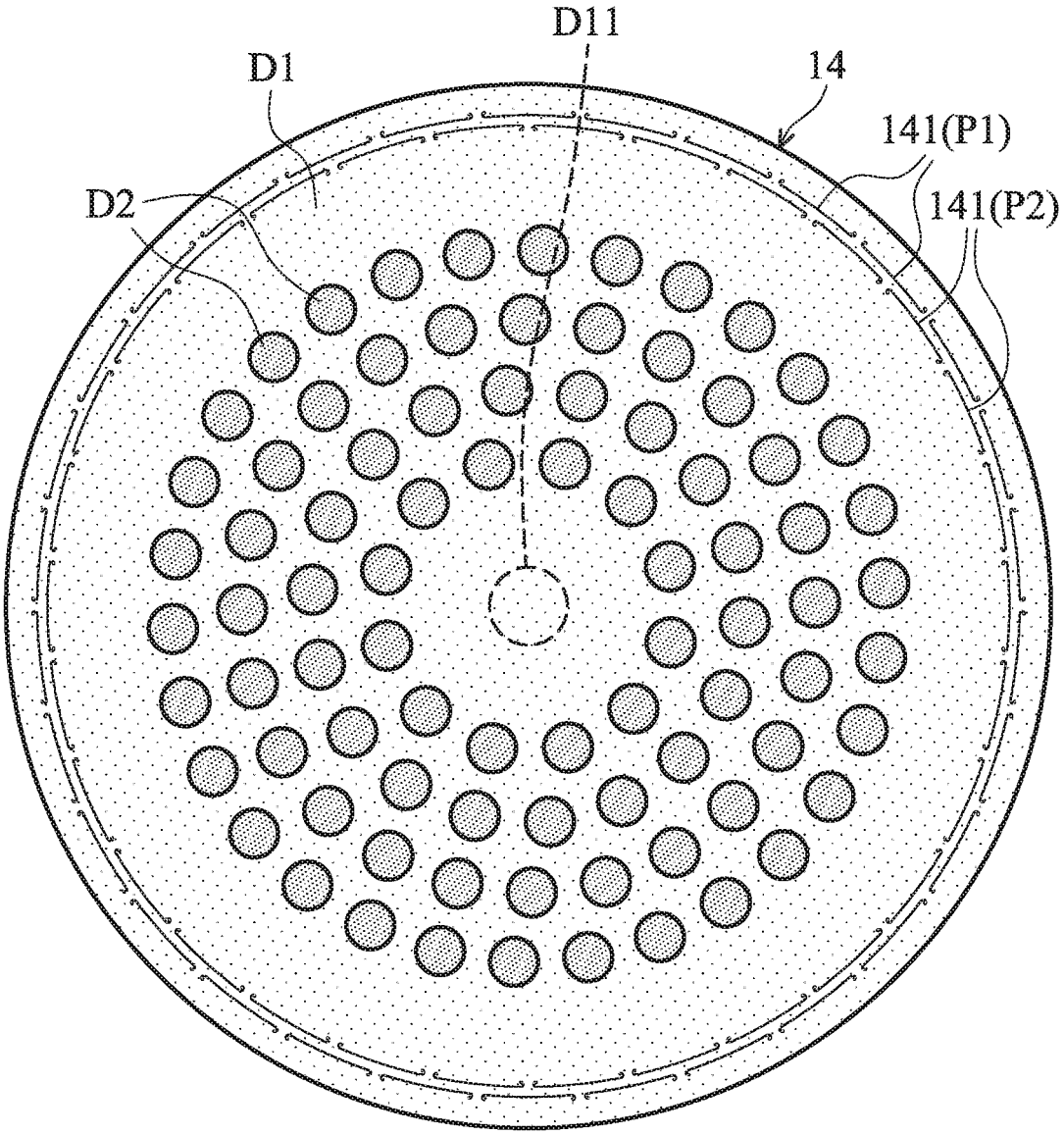
FIG. 6A is a schematic diagram showing a diaphragm 14 of the MEMS microphone M, in accordance with another embodiment of the invention.

FIG. 6A is a schematic diagram showing a diaphragm 14 of the MEMS microphone M, in accordance with another embodiment of the invention. Referring to FIG. 6A, the diaphragm 14 in this embodiment is different from FIG. 5A in that the diaphragm 14 includes one implantation portion D1 and several round implantation portions D2 arranged in the implantation portion D1, wherein each of the implantation portions D2 has an average concentration higher than the implantation portion D1. Here, a small round area D11 is defined in the implantation portion D1 and connected to the additional insulating layer 17 (FIGS. 1A and 1B).

Figure 6B:
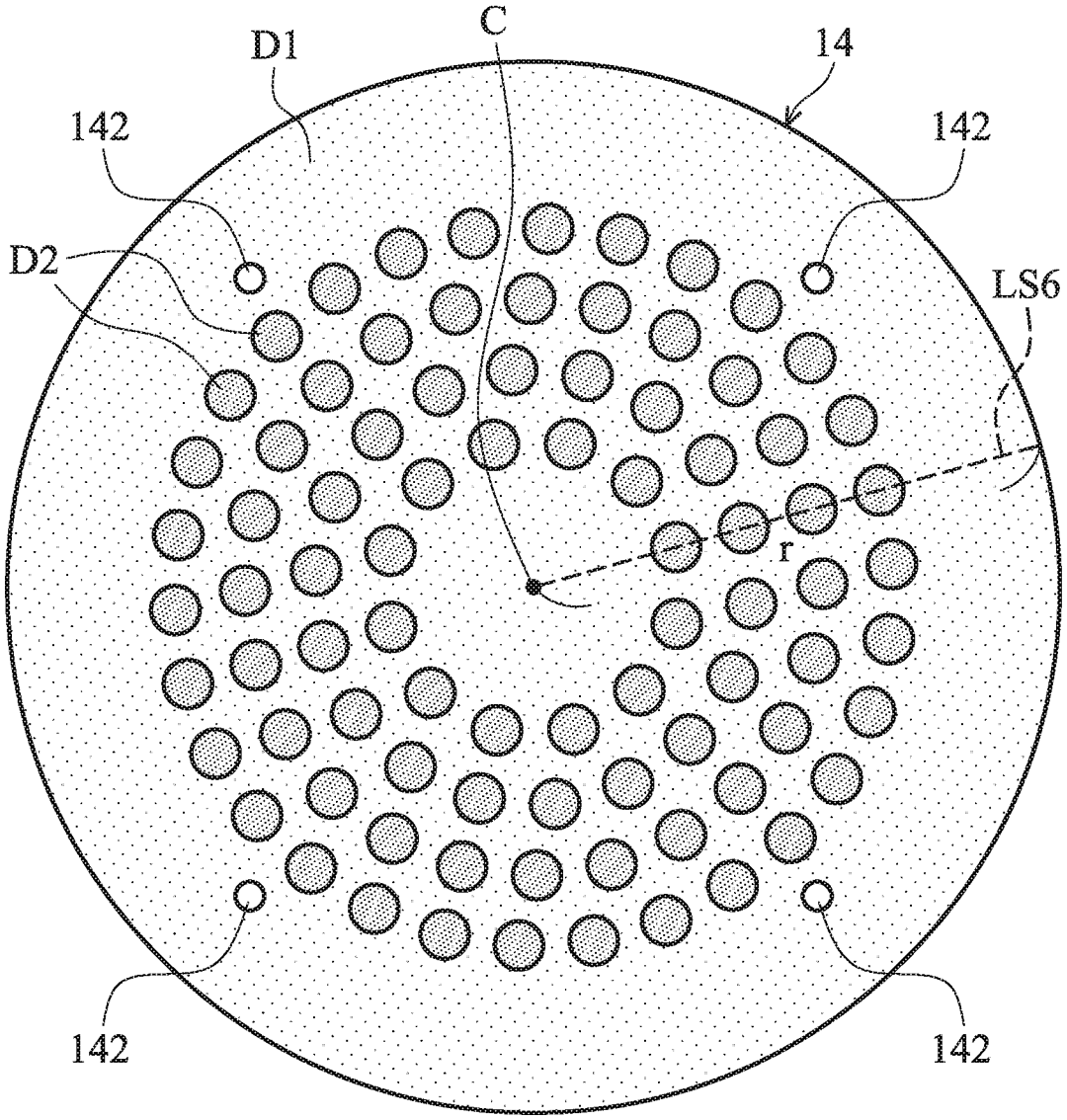
FIG. 6B is a schematic diagram showing a diaphragm 14 of the MEMS microphone M, in accordance with another embodiment of the invention.

FIG. 6B is a schematic diagram showing a diaphragm 14 of the MEMS microphone M, in accordance with another embodiment of the invention. Referring to FIG. 6B, the diaphragm 14 in this embodiment is different from FIG. 6A in that the long slots 141 are replaced by a number of vent holes 142 formed on the implantation portion D1, and the center C of the diaphragm 14 is spaced apart from the second insulating protrusions 134, as the air gap G shown in FIG. 1C.

Figure 6C:
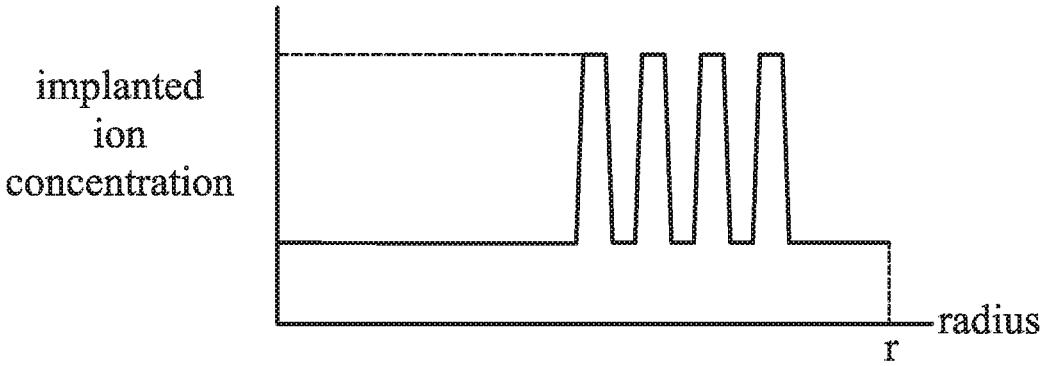
FIG. 6C shows the relationship between the implanted ion concentration and the radius of the diaphragm 14 along line LS6 in FIG. 6B.

FIG. 6C shows the relationship between the implanted ion concentration and the radius of the diaphragm 14 along line LS6 in FIG. 6B. Referring to FIGS. 6B and 6C, the implantation portion D1 of the diaphragm 14 has a maximum radius r, and a regular sawtooth-like curve is presented in FIG. 6C. Here, since the implanted ion concentrations in the implantation portions D2 are higher than the implantation portion D1, the implantation portions D2 can be more flexible than the implantation portion D1, thereby increasing the AOP and SNR of the MEMS microphone M.

Figure 7A:
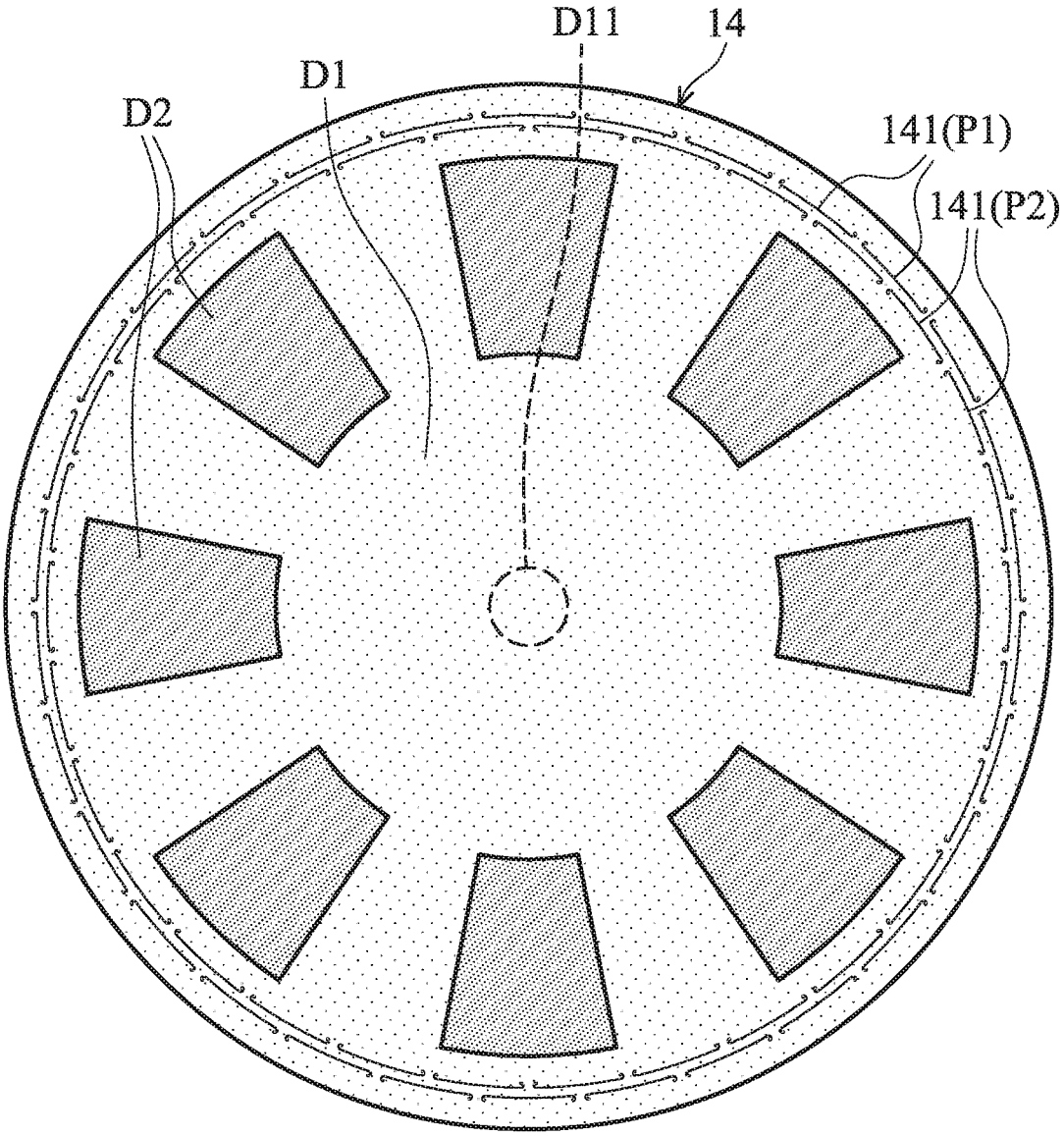
FIG. 7A is a schematic diagram showing a diaphragm 14 of the MEMS microphone M, in accordance with another embodiment of the invention.

FIG. 7A is a schematic diagram showing a diaphragm 14 of the MEMS microphone M, in accordance with another embodiment of the invention. Referring to FIG. 7A, the diaphragm 14 in this embodiment is different from FIG. 4A in that several fan-shaped implantation portions D2 are radially arranged around the center of the diaphragm 14 and encompassed by the implantation portion D1. Here, a small round area D11 is defined in the implantation portion D1 and connected to the additional insulating layer 17 (FIGS. 1A and 1B).

Figure 7B:
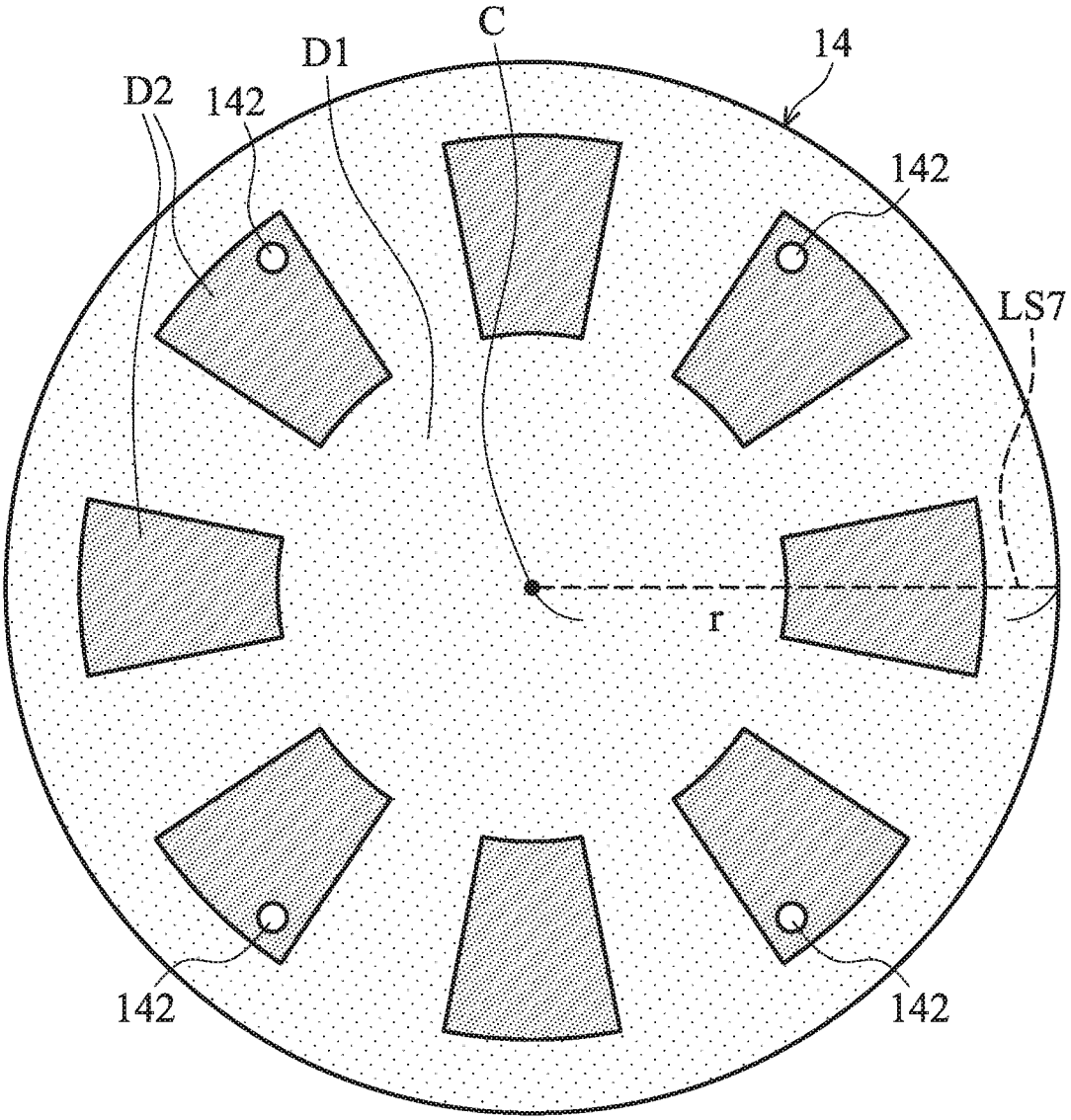
FIG. 7B is a schematic diagram showing a diaphragm 14 of the MEMS microphone M, in accordance with another embodiment of the invention.

FIG. 7B is a schematic diagram showing a diaphragm 14 of the MEMS microphone M, in accordance with another embodiment of the invention. Referring to FIG. 7B, the diaphragm 14 in this embodiment is different from FIG. 7A in that the long slots 141 are replaced by a number of vent holes 142 formed on the implantation portions D2, and the center C of the diaphragm 14 is spaced apart from the second insulating protrusions 134, as the air gap G shown in FIG. 1C.

Figure 7C:
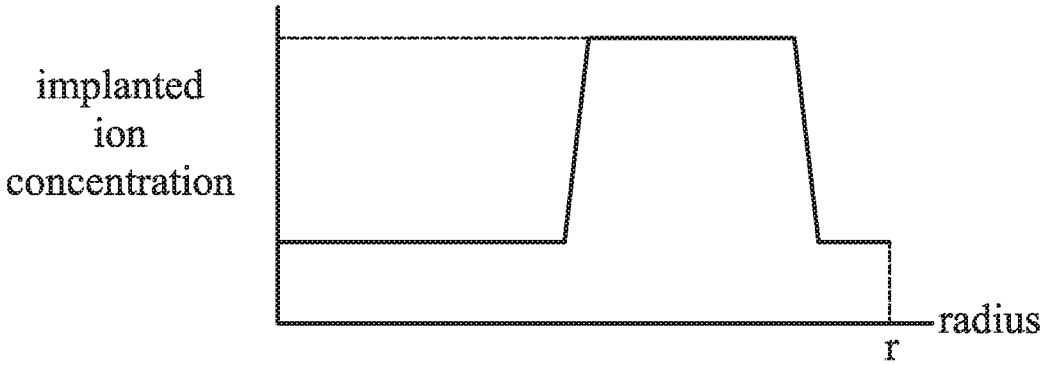
FIG. 7C shows the relationship between the implanted ion concentration and the radius of the diaphragm 14 along line LS7 in FIG. 7B.

FIG. 7C shows the relationship between the implanted ion concentration and the radius of the diaphragm 14 along line LS7 in FIG. 7B. Referring to FIGS. 7B and 7C, the diaphragm 14 has a maximum radius r, and each of the implantation portions D2 has an average concentration higher than the implantation portion D1. Thus, the implantation portions D2 can be more flexible than the implantation portion D1, thereby increasing the AOP and SNR of the MEMS microphone M.

Figure 7D:
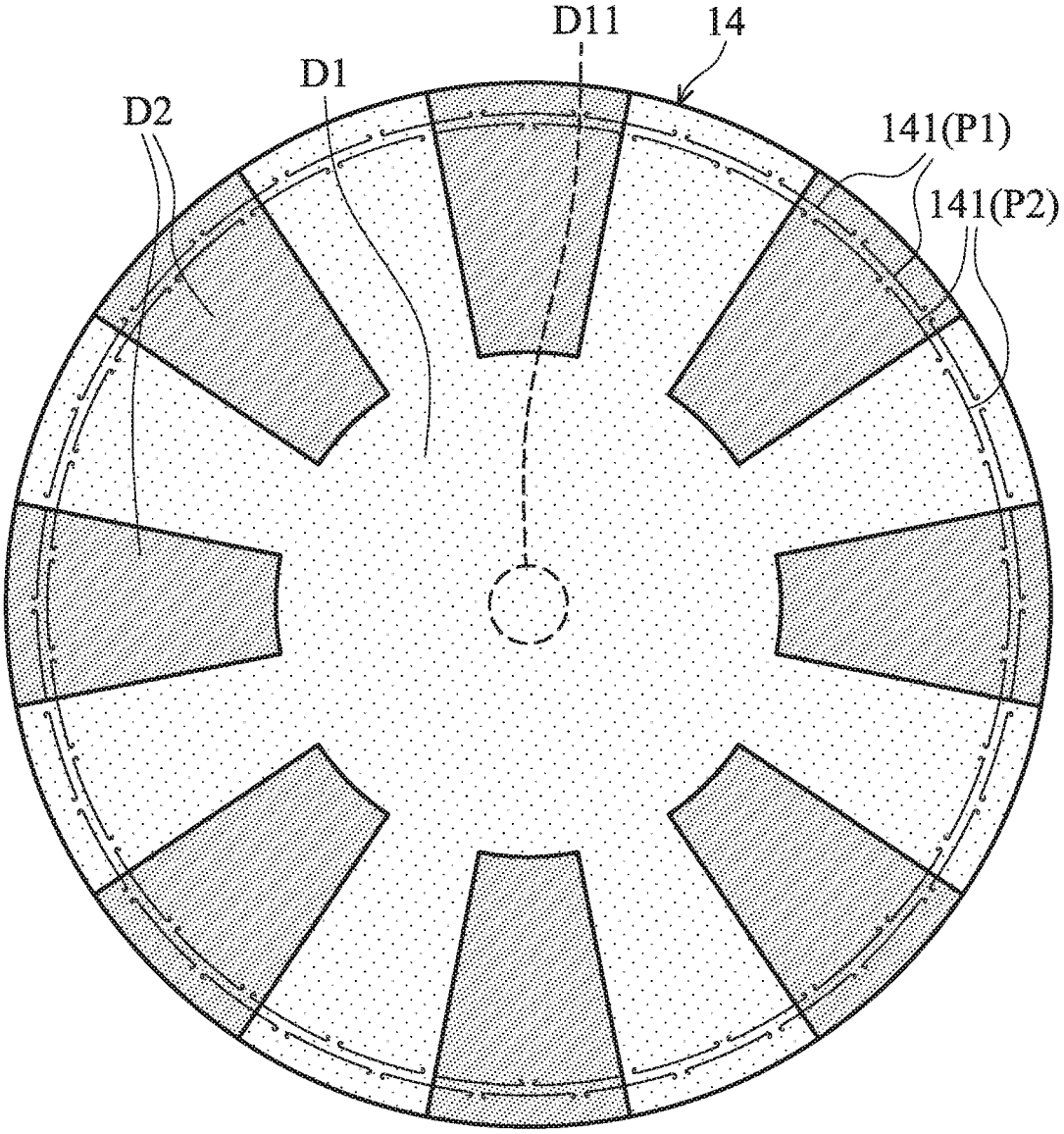
FIG. 7D is a schematic diagram showing a diaphragm 14 of the MEMS microphone M, in accordance with another embodiment of the invention.

FIG. 7D is a schematic diagram showing a diaphragm 14 of the MEMS microphone M, in accordance with another embodiment of the invention. Referring to FIG. 7D, the diaphragm 14 in this embodiment is different from FIG. 7A in that several fan-shaped implantation portions D2 extend to the perimeter of the diaphragm 14, wherein a small round area D11 is defined in the inner implantation portion D1 and connected to the additional insulating layer 17 (FIGS. 1A and 1B).

Figure 7E:
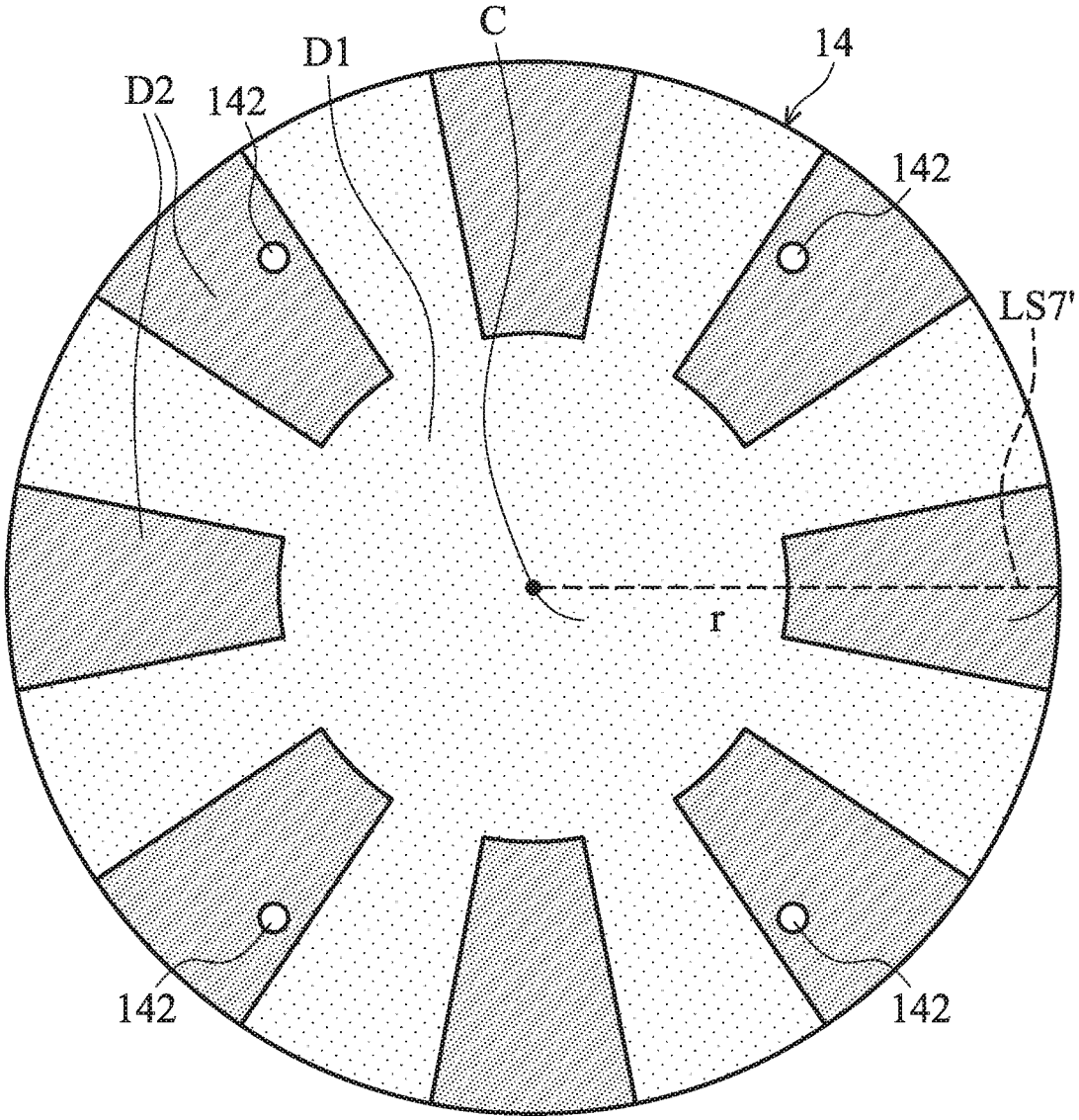
FIG. 7E is a schematic diagram showing a diaphragm 14 of the MEMS microphone M, in accordance with another embodiment of the invention.

FIG. 7E is a schematic diagram showing a diaphragm 14 of the MEMS microphone M, in accordance with another embodiment of the invention. Referring to FIG. 7E, the diaphragm 14 in this embodiment is different from FIG. 7D in that the long slots 141 are replaced by a number of vent holes 142 formed on the implantation portions D2, and the center C of the diaphragm 14 is spaced apart from the second insulating protrusions 134, as the air gap G shown in FIG. 1C.

Figure 7F:
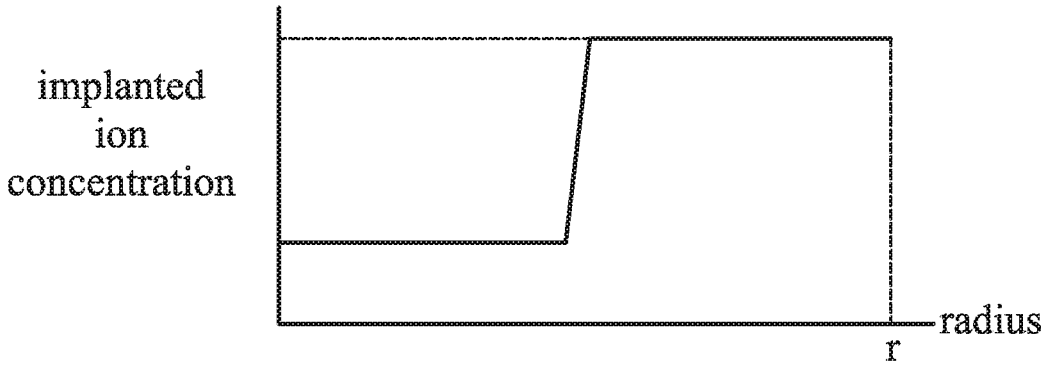
FIG. 7F shows the relationship between the implanted ion concentration and the radius of the diaphragm 14 along line LS7' in FIG. 7E.

FIG. 7F shows the relationship between the implanted ion concentration and the radius of the diaphragm 14 along line LS7' in FIG. 7E. Referring to FIGS. 7E and 7F, the diaphragm 14 has a maximum radius r, and each of the implantation portions D2 has an average concentration higher than the implantation portion D1. Thus, the implantation portions D2 can be more flexible than the implantation portion D1, thereby increasing the AOP and SNR of the MEMS microphone M.

Figure 8A:
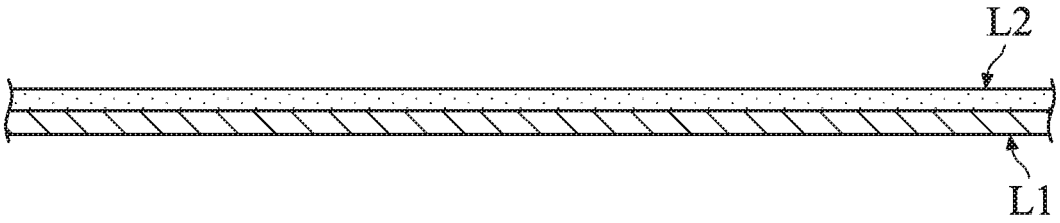
FIG. 8A-8E are schematic diagrams showing how to produce a diaphragm of a MEMS microphone by semiconductor processes.
Figure 8B:
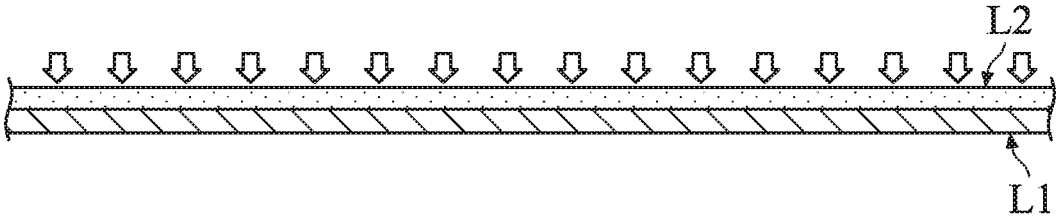
Figure 8C:
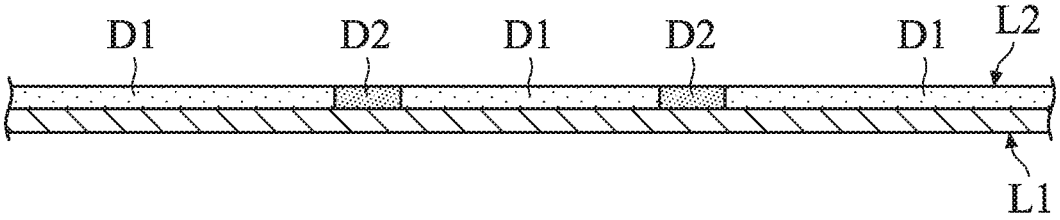

FIG. 8A-8E are schematic diagrams showing the steps of producing a diaphragm of a MEMS microphone by semiconductor processes. First, a sacrificial layer L1 is provided, and a sensing layer L2 (e.g. polycrystalline silicon) is formed on the sacrificial layer L1 (FIG. 8A). Subsequently, the sensing layer L2 is implanted with a first dopant such as p-type or n-type dopant (e.g. phosphorus or boron), as the arrows indicate in FIG. 8B, so that a first implantation area of the sensing layer L2 is defined. After the implantation process of the sensing layer L2, some specific regions of the sensing layer L2 is implanted with a first dopant such as p-type or n-type dopant (e.g. phosphorus or boron), so that a second implantation area of the sensing layer L2 is defined, wherein the second implantation area has a shape different from the first implantation area. Hence, the sensing layer L2 can form at least a first implantation portion D1 and a second implantation portion D2 that have different implantation concentrations, as shown in FIG. 8C. In some embodiments, the first dopant may be the same as or different material from the second dopant.

It should be noted that the dosage of the first and/or second dopants implanted into the sensing layer L2 is in ranged from 1E10 to 1E19 $cm^{-2}$. In some embodiments, the dosage in the implantation steps has a highest value and a lowest value, wherein the difference between the highest value and the lowest value exceeds 0.1E15 $cm^{-2}$.

Figure 8D:
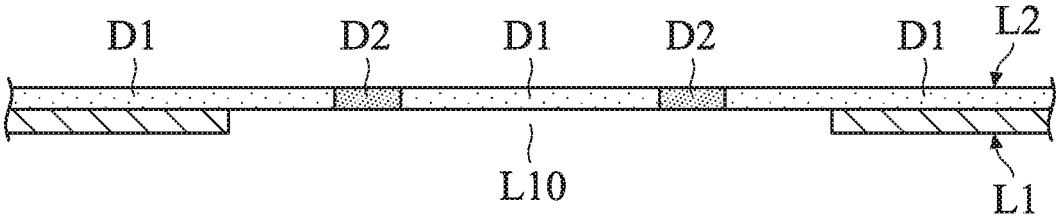
Figure 8E:
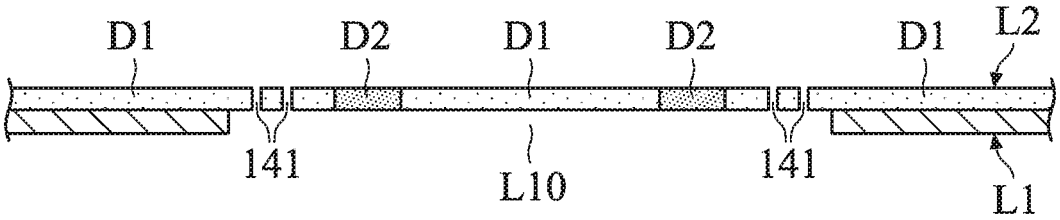
Figure 8F:
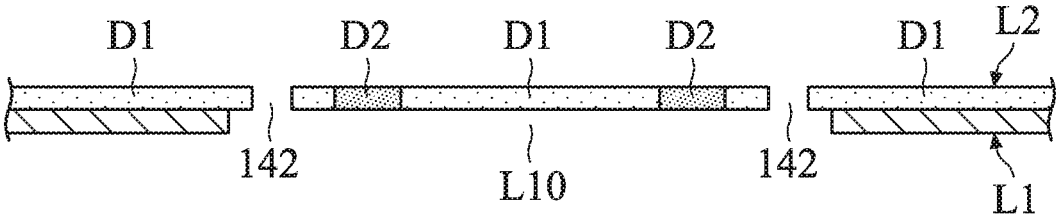
FIG. 8F is a schematic diagram showing a number of vent holes 142 formed of the sensing layer L2 (diaphragm) and communicated with the opening L10, in accordance with another embodiment of the invention.

Referring to FIG. 8D, the next step is to remove a part of the sacrificial layer L1 to form an opening L10. Thus, a part of the sensing layer L2 including the first and second implantation portions D1 and D2 can form a diaphragm that is suspended across the opening L10. In some embodiments, a number of long slots 141 may be formed the sensing layer L2 (diaphragm) and communicated with the opening L10, as shown in FIG. 8E. However, in some embodiments as shown in FIG. 8F, a number of vent holes 142 may be formed the sensing layer L2 (diaphragm) and communicated with the opening L10. Thus, when the sensing layer L2 (diaphragm) is affected by acoustic pressure from ambient sound waves, air can flow through the slots 141 (FIG. 8E) or the vent holes 142 (FIG. 8F) to relieve the residual stress and endure the wind load.

As mentioned above, the diaphragm 14 of these embodiments may be implanted with a p-type or n-type dopant (e.g. phosphorus or boron), and the concentrations in the implantation portions D1 and D2 of the diaphragm 14 are from 1E16 to 1E23 $cm^{-3}$. In some embodiments, the difference of peak concentrations between implantation portion D1 and the implantation portion D2 may exceed more than 0.1E16 cm−3.

In summary, since the implantation portion D2 of the diaphragm has a higher concentration and is more flexible than the implantation portion D1, the sensitivity and linearity of the MEMS microphone can be improved, and the AOP and SNR (Signal-to-Noise Ratio) of the MEMS Microphone can also be increased.

Although embodiments of the present disclosure and their advantages have been described in detail, it should be understood that various changes, substitutions and alterations can be made herein without departing from the spirit and scope of the disclosure as defined by the appended claims. For example, it will be readily understood by those skilled in the art that many of the features, functions, processes, and materials described herein may be varied while remaining within the scope of the present disclosure. Moreover, the scope of the present application is not intended to be limited to the particular embodiments of the process, machine, manufacture, composition of matter, means, methods and steps described in the specification. As one of ordinary skill in the art will readily appreciate from the disclosure of the present disclosure, processes, machines, manufacture, compositions of matter, means, methods, or steps, presently existing or later to be developed, that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps. In addition, each claim constitutes a separate embodiment, and the combination of various claims and embodiments are within the scope of the disclosure.

What is claimed is:

1. A micro-electro-mechanical system (MEMS) microphone, comprising:

a substrate;

a backplate, disposed on a side of the substrate;

a diaphragm, movably disposed on the side of the backplate and separated from the backplate by a gap, wherein the diaphragm includes a plurality of implantation portions, and the implantation portions have different average concentrations; and a plurality of outer slots and inner slots formed in an annular area of the diaphragm and configured in concentric circles around a center of the diaphragm, wherein the outer and inner slots respectively have a c-shaped structure and are oriented toward opposite directions, and the outer and inner slots are arranged in a staggered manner with respect to the center of the diaphragm.

2. The micro-electro-mechanical system (MEMS) microphone of claim 1, wherein the implantation portions have different concentration-depth profiles.

3. The micro-electro-mechanical system (MEMS) microphone of claim 1, wherein the diaphragm defines a coordinate system, and the implantation portions are arranged in a symmetrical manner with respect to an original point of the coordinate system.

4. The micro-electro-mechanical system (MEMS) microphone of claim 3, wherein the coordinate system is a cylindrical coordinate system or a Cartesian coordinate system.

5. The micro-electro-mechanical system (MEMS) microphone of claim 1, wherein the concentrations in the implantation portions of the diaphragm are from 1E16 to 1E23 cm−3.

6. The micro-electro-mechanical system (MEMS) microphone of claim 1, wherein each of the implantation portions has a peak concentration, and the difference of the peak concentrations exceeds 0.1E16 cm−3.

7. The micro-electro-mechanical system (MEMS) microphone of claim 1, wherein the implantation portions are implanted with a p-type or n-type dopant.

8. The micro-electro-mechanical system (MEMS) microphone of claim 1, further comprising an additional insulating layer connected between the backplate and the diaphragm.

9. The micro-electro-mechanical system (MEMS) microphone of claim 1, wherein the implantation portions include a first implantation portion and a second implantation portion surrounding the first implantation portion, and the second implantation portion has a higher concentration than the first implantation portion.

10. The micro-electro-mechanical system (MEMS) microphone of claim 9, wherein the implantation portions include two first implantation portions, and the second implantation portion is disposed between the first implantation portions, and the second implantation portion has a higher concentration than the first implantation portions.

11. The micro-electro-mechanical system (MEMS) microphone of claim 1, wherein the implantation portions include a plurality of first implantation portions and a plurality of second implantation portions arranged in concentric circles, and each of the second implantation portions has a higher concentration than the first implantation portions.

12. The micro-electro-mechanical system (MEMS) microphone of claim 11, wherein one of the first implantation portions is located at the center of the diaphragm.

13. The micro-electro-mechanical system (MEMS) microphone of claim 11, wherein the concentrations of the second implantation portions are different from each other.

14. The micro-electro-mechanical system (MEMS) microphone of claim 1, wherein the implantation portions include a first implantation portion and a plurality of second implantation portions radially arranged around the center of the diaphragm.

15. The micro-electro-mechanical system (MEMS) microphone of claim 14, wherein the second implantation portions are encompassed by the first implantation portion.

16. The micro-electro-mechanical system (MEMS) microphone of claim 15, wherein each of the second implantation portions has a fan-shaped structure.

17. The micro-electro-mechanical system (MEMS) microphone of claim 15, wherein the second implantation portions extend to a perimeter of the diaphragm.

18. A method for manufacturing the diaphragm of the micro-electro-mechanical system (MEMS) microphone as claimed in claim 1, wherein the implantation portions include a first implantation portion and a second implantation portion, and the method comprises the steps of:

forming a sacrificial layer;

forming a sensing layer on the sacrificial layer;

defining a first implantation area on the sensing layer, wherein the first implantation area is implanted with a first dopant;

defining a second implantation area on the sensing layer, wherein the second implantation area is implanted with a second dopant, and the second implantation area has a shape different from the first implantation area; and removing a part of the sacrificial layer to form an opening, whereby the sensing layer forms the diaphragm across the opening, and the first implantation portion has a concentration of the first dopant different from the second implantation portion of the second dopant;

wherein a plurality of outer slots and inner slots are formed in an annular area of the diaphragm and configured in concentric circles around a center of the diaphragm, and the outer and inner slots respectively have a c-shaped structure and are oriented toward opposite directions, wherein the outer and inner slots are arranged in a staggered manner with respect to the center of the diaphragm.

* * * * *